US008162304B2

(12) United States Patent
Iguchi et al.

(10) Patent No.: US 8,162,304 B2
(45) Date of Patent: Apr. 24, 2012

(54) SHEET FINISHER, IMAGE FORMING APPARATUS USING THE SAME, AND SHEET FINISHING METHOD

(75) Inventors: Ken Iguchi, Sunto-gun (JP); Katsuya Sasahara, Izu (JP); Takahiro Kawaguchi, Mishima (JP); Hiroyuki Taguchi, Kawasaki (JP); Katsuhiko Tsuchiya, Numazu (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/181,656

(22) Filed: Jul. 13, 2011

(65) Prior Publication Data

US 2011/0278784 A1 Nov. 17, 2011

Related U.S. Application Data

(63) Continuation of application No. 12/104,495, filed on Apr. 17, 2008, now Pat. No. 7,997,571.

(60) Provisional application No. 60/945,377, filed on Jun. 21, 2007, provisional application No. 60/945,376, filed on Jun. 21, 2007, provisional application No. 60/945,373, filed on Jun. 21, 2007, provisional application No. 60/944,967, filed on Jun. 19, 2007, provisional application No. 60/944,830, filed on Jun. 19, 2007, provisional application No. 60/944,827, filed on Jun. 19, 2007, provisional application No. 60/944,822, filed on Jun. 19, 2007, provisional application No. 60/944,821, filed on Jun. 19, 2007.

(51) Int. Cl.
*B65H 37/04* (2006.01)

(52) U.S. Cl. ..... 270/45; 270/20.1; 270/32; 270/37; 270/58.07

(58) Field of Classification Search ..... 270/20.1, 270/32, 37, 45, 58.07, 58.27; 493/435, 445
See application file for complete search history.

(56) References Cited

U.S. PATENT DOCUMENTS 6,905,118 B2 6/2005 Yamada et al.

(Continued)

FOREIGN PATENT DOCUMENTS

JP 07-002426 1/1995

(Continued)

OTHER PUBLICATIONS

Office Action for U.S. Patent Application No. mailed on Aug. 23, 2010 corresponding to U.S. Appl. No. 12/104,495, filed Mar. 31, 2011.

(Continued)

*Primary Examiner* — Leslie A Nicholson, III
(74) *Attorney, Agent, or Firm* — Turocy & Watson, LLP

(57) ABSTRACT

A sheet finisher of the invention includes a saddle stitch unit configured to stitch a center of a sheet bundle in which printed sheets are bundled, a fold unit configured to fold the center stitched by the saddle stitch unit and to form a fold line, a fold reinforcing unit that includes a reinforce roller, moves the reinforce roller along a direction of the fold line while applying pressure by the reinforce roller to the fold line of the sheet bundle transported from the fold unit, and reinforces the fold line, and a control unit configured to transport the sheet bundle from the fold unit to the fold reinforcing unit and to control to stop the fold line of the sheet bundle at a position of the reinforce roller, and the control unit changes, according to a thickness of the sheet bundle, a transport distance from a specified position in the fold reinforcing unit to the position where the sheet bundle is stopped.

15 Claims, 22 Drawing Sheets

U.S. PATENT DOCUMENTS

| | | | |
|---|---|---|---|
| 7,172,186 | B2 | 2/2007 | Saito et al. |
| 7,328,893 | B2 | 2/2008 | Kawatsu et al. |
| 2005/0230895 | A1 | 10/2005 | Kawatsu et al. |

FOREIGN PATENT DOCUMENTS

| | | |
|---|---|---|
| JP | 2003-182928 | 7/2003 |
| JP | 2004-059304 | 2/2004 |
| JP | 2004-106991 | 4/2004 |
| JP | 2005-089140 | 4/2005 |
| JP | 2005-162345 | 6/2005 |
| JP | 2007-076793 | 3/2007 |

OTHER PUBLICATIONS

Office Action for U.S. Patent Application No. mailed on Dec. 6, 2010 corresponding to U.S. Appl. No. 12/104,495, filed Mar. 31, 2011.

AT MOVEMENT OF ROLLER UNIT
(AT FOLD LINE REINFORCING OPERATION)

ROLLER UNIT HOME POSITION

SHEET FINISHER, IMAGE FORMING APPARATUS USING THE SAME, AND SHEET FINISHING METHOD

CROSS-REFERENCE TO RELATED APPLICATIONS

This application is a Continuation of application Ser. No. 12/104,495 filed Apr. 17, 2008, which claims the benefit of priority from U.S. Provisional application Ser. No. 60/944,821 filed Jun. 19, 2007, U.S. Provisional application Ser. No. 60/944,822 filed Jun. 19, 2007, U.S. Provisional application Ser. No. 60/944,827 filed Jun. 19, 2007, U.S. Provisional application Ser. No. 60/944,830 filed Jun. 19, 2007, U.S. Provisional application Ser. No. 60/944,967 filed Jun. 19, 2007, U.S. Provisional application Ser. No. 60/945,373 filed Jun. 21, 2007, U.S. Provisional application Ser. No. 60/945,376 filed Jun. 21, 2007, and U.S. Provisional application Ser. No. 60/945,377 filed Jun. 21, 2007, the entire contents of all of which is incorporated herein by reference.

BACKGROUND OF THE INVENTION

1. Field of the Invention

The present invention relates to a sheet finisher, an image forming apparatus using the same, and a sheet finishing method, particularly to a sheet finisher to perform a folding process of a printed sheet, an image forming apparatus using the same, and a sheet finishing method.

2. Description of the Related Art

Hitherto, there is known a sheet finisher which is placed downstream of an image forming apparatus, such as a copier, a printer or an MFP (Multi-Function Peripheral), and performs a post-processing, such as a punching process or a stitching process, on a printed sheet.

Recently, the function of this sheet finisher is diversified, and a sheet finisher is proposed which has, in addition to the function of the punching process and the stitching process, the function of a folding process to fold a part of a sheet, and the function of a saddle-stitching and folding process to staple the center of a sheet and then to fold the sheet at the center (JP-A 2004-59304, JP-A 2003-182928, etc.)

In the sheet finisher having the function of the saddle-stitching and folding process, it becomes possible to form a booklet (to bind a book) from a plurality of printed sheets.

In the saddle-stitching and folding process proposed hitherto, after the canter of sheets is stitched with staples or the like, a process is performed in which a fold line is formed on the stitched part by a pair of rollers called fold rollers and folding is performed. At this time, a plate-like member called a fold blade is brought into contact with the stitched part of the sheet bundle, and is pressed into a nip of the fold roller pair to form the fold line on the sheet bundle.

However, the time in which the folded part of the sheet bundle is pressed by the nip of the fold rollers is short, and the whole folded part is simultaneously pressed by the nip of the fold rollers, and accordingly, the pressure is dispersed to the whole fold line. Thus, the fold line formed by the fold rollers becomes the fold line to which the pressure is not sufficiently applied. Particularly, in the case where the number of sheets is large, or in the case where a thick sheet is contained in the sheet bundle, the fold line often becomes incomplete.

In order to deal with this problem, JP-A 2004-59304 or JP-A 2003-182928 discloses a technique in which a roller called a reinforce roller is additionally provided, and the fold line formed by the fold rollers is reinforced by this reinforce roller.

In the technique disclosed in JP-A 2004-59304, the sheet bundle pushed out from the fold roller is temporarily stopped on a guide plate, and the reinforce roller is moved along the fold line while applying pressure to the fold line of the sheet bundle from above. The fold line nipped between the guide plate and the reinforce roller is reinforced by the pressure generated between the guide plate and the reinforce roller.

JP-A 2003-182928 also discloses a technique in which a fold line pushed out from a fold roller is nipped in a nip of a pair of reinforce rollers, and the pair of reinforce rollers is moved along the fold line to reinforce the fold line.

Incidentally, hitherto, in the control (drive control of a sheet bundle in a transport direction) to stop the sheet bundle pushed out from a fold roller at a position on a guide plate, transport control is often used in which a sensor to detect the passing of the sheet bundle is provided at a position short of the guide plate, and the sheet bundle is stopped at a position which the sheet bundle has reached after being transported by a specified distance from the position where the leading edge of the sheet bundle passes through this sensor. By this transport control, the leading edge (position of the fold line) of the sheet bundle is stopped at almost the center of a reinforce roller.

However, in the case where an actuator-type sensor is used as the sensor to detect the passing of the sheet bundle, there arises a problem that the position where the passing of the leading edge is detected varies according to the thickness of the sheet bundle, and the sheet bundle cannot be stopped at a desired position.

On the other hand, in the case where the thickness of the sheet bundle is thin, the thickness of a staple inserted in the fold line becomes dominant over the thickness of the sheet bundle. In such a case, there arise a problem that when the use is made for a long period of time in a state where the positional relation between the reinforce roller and the fold line is always constant, the surface of the reinforce roller is damaged by the staple.

SUMMARY OF THE INVENTION

The present invention has been made in view of the above circumstances, and it is an object to provide a sheet finisher which performs a saddle-stitching and folding process, and which controls driving of a sheet bundle in a transport direction according to the thickness of the sheet bundle to stop a fold line at an appropriate position relative to a reinforce roller, and can reduce damage of the reinforce roller caused by a staple in a case where the sheet bundle is thin, an image forming apparatus using the same, and a sheet finishing method.

In order to achieve the above object, according to an aspect of the invention, a sheet finisher includes a saddle stitch unit configured to stitch a center of a sheet bundle in which printed sheets are bundled, a fold unit configured to fold the center stitched by the saddle stitch unit and to form a fold line, a fold reinforcing unit that includes a reinforce roller, moves the reinforce roller along a direction of the fold line while applying pressure by the reinforce roller to the fold line of the sheet bundle transported from the fold unit, and reinforces the fold line, and a control unit configured to transport the sheet bundle from the fold unit to the fold reinforcing unit and control to stop the fold line of the sheet bundle at a position of the reinforce roller, and the control unit changes, according to a thickness of the sheet bundle, a transport distance from a specified position in the fold reinforcing unit to the position where the sheet bundle is stopped.

Besides, according to another aspect of the invention, an image forming apparatus includes a read unit configured to read an original document and to generate image data, an image forming unit configured to print the image data to a sheet, and a sheet finisher to perform at least a stitching process and a folding process on the sheet printed by the image forming unit, the sheet finisher includes a saddle stitch unit configured to stitch a center of a sheet bundle in which printed sheets are bundled, a fold unit configured to fold the center stitched by the saddle stitch unit and to form a fold line, a fold reinforcing unit that includes a reinforce roller, moves the reinforce roller along a direction of the fold line while applying pressure by the reinforce roller to the fold line of the sheet bundle transported from the fold unit, and reinforces the fold line, and transport control means for transporting the sheet bundle from the fold unit configured to the fold reinforcing unit and for controlling to stop the fold line of the sheet bundle at a position of the reinforce roller, and a control unit configured to transport the sheet bundle from the fold unit to the fold reinforcing unit and control to stop the fold line of the sheet bundle at a position of the reinforce roller, and the control unit changes, according to a thickness of the sheet bundle, a transport distance from a specified position in the fold reinforcing unit to the position where the sheet bundle is stopped.

Further, according to another aspect of the present invention, a sheet finishing method includes stitching a center of a sheet bundle in which printed sheets are bundled, folding the sheet bundle at the stitched center to form a fold line, transporting the sheet bundle of which the fold line is formed and controlling to stop the fold line of the sheet bundle at a position of the reinforce roller, and reinforcing the fold line by moving a reinforce roller along a direction of the fold line while pressing the reinforce roller to the fold line, and, in the transporting, a transport distance from a specified position to the position where the sheet bundle is stopped is changed according to a thickness of the sheet bundle.

DETAILED DESCRIPTION OF THE PREFERRED EMBODIMENTS

An embodiment of a sheet finisher of the present invention, an image forming apparatus using the same, and a sheet finishing method will be described with reference to the accompanying drawings.

(1) Structure of the Image Forming Apparatus

Figure 1:
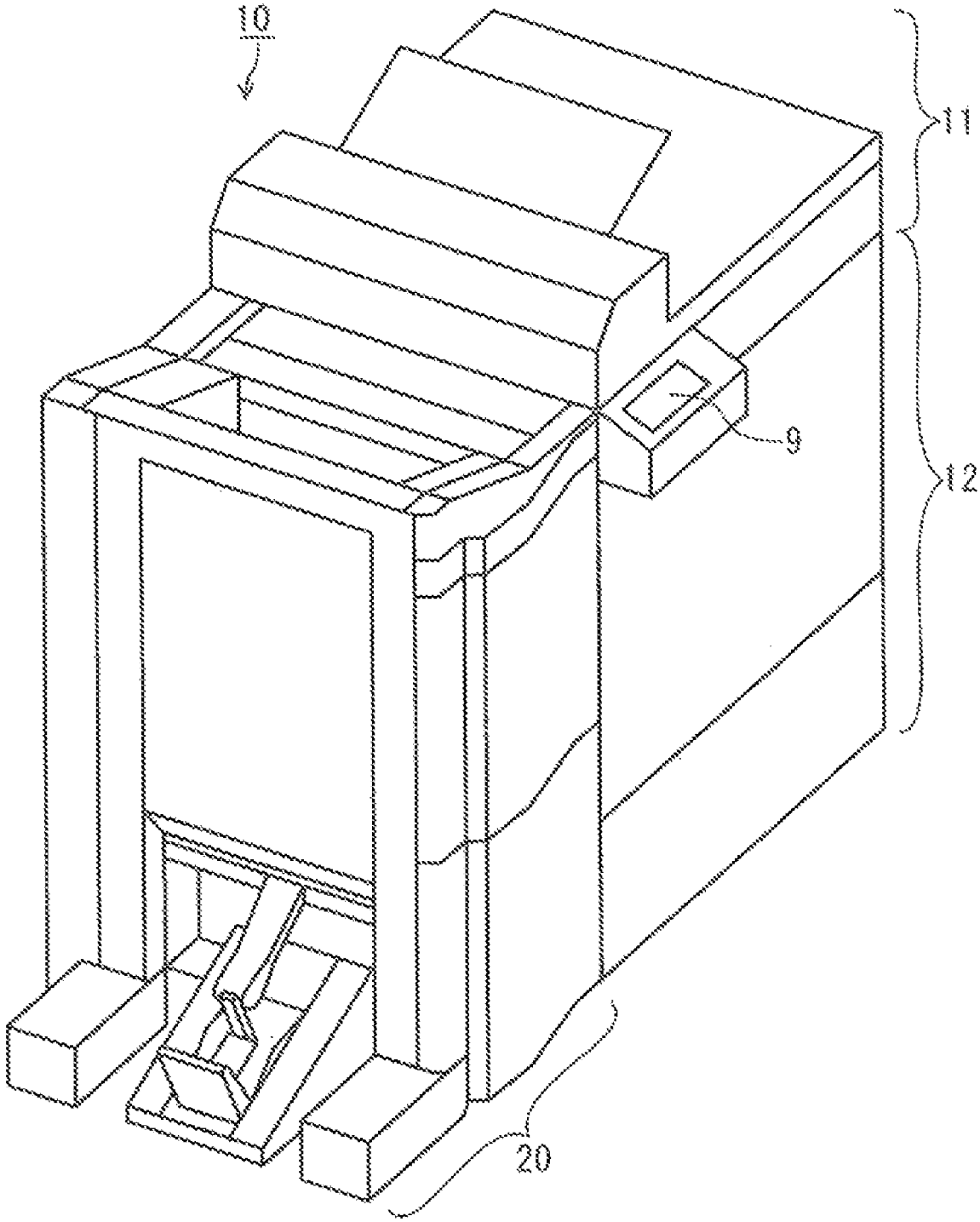
FIG. 1 is a perspective view showing an outer appearance example of an image forming apparatus of an embodiment of the invention.

FIG. 1 is an outer appearance perspective view showing a basic structural example of an image forming apparatus 10 of an embodiment. The image forming apparatus 10 includes a read unit 11 to read an original document, an image forming unit 12 to print the image data of the read original document to a sheet by an electrophotographic system, and a sheet finisher 20 to perform a post-process, such as a sorting process, a punching process, a folding process, or a saddle-stitching process, on the printed sheet. Besides, the image forming unit 12 is provided with an operation unit 9 by which a user performs various operations.

Figure 2:
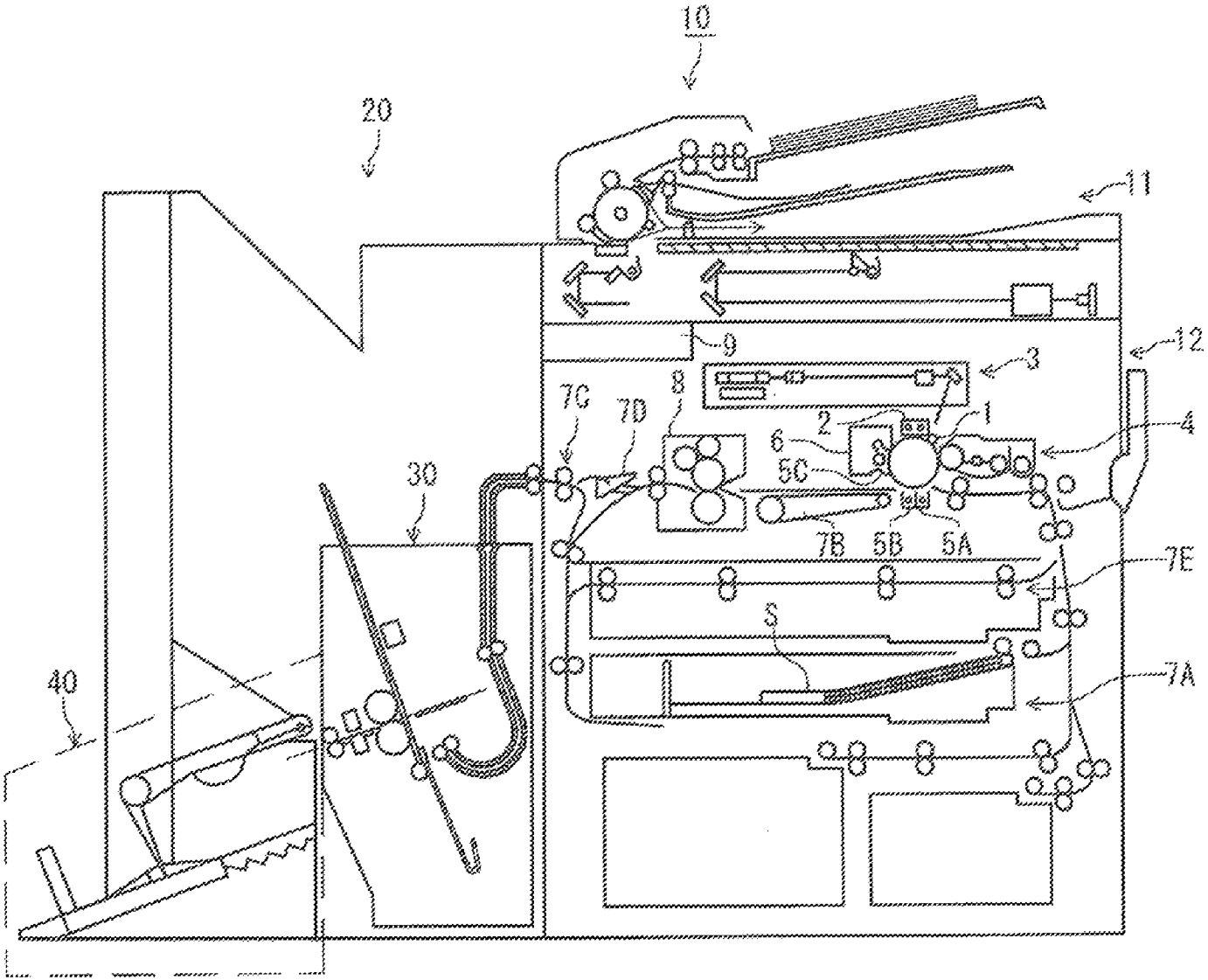
FIG. 2 is a sectional view showing a structural example of the image forming apparatus of the embodiment of the invention.

FIG. 2 is a sectional view showing a detailed structural example of the image forming apparatus 10.

The image forming unit 12 of the image forming apparatus 10 includes a photoconductive drum 1 in the vicinity of the center thereof, and a charging unit 2, an exposing unit 3, a developing unit 4, a transfer unit 5A, a charge removing unit 5B, a separating pawl 5C, and a cleaning unit 6 are respectively disposed around the photoconductive drum 1. Besides, a fixing unit 8 is provided downstream of the charge removing unit 5B. An image forming process is performed by these units roughly in the following procedure.

First, the surface of the photoconductive drum 1 is uniformly charged by the charging unit 2. On the other hand, an original document read by the read unit 11 is converted into image data, and is inputted to the exposing unit 3. In the exposing unit 3, a laser beam corresponding to the level of the image data is irradiated to the photoconductive drum 1, and an electrostatic latent image is formed on the photoconductive drum 1. The electrostatic latent image is developed with toner supplied from the developing unit 4, and a toner image is formed on the photoconductive drum 1.

On the other hand, a sheet contained in a sheet containing unit 7 is transported to a transfer position (gap between the photoconductive drum 1 and the transfer unit 5A) through some transport rollers. At the transfer position, the toner image is transferred from the photoconductive drum 1 to the sheet by the transfer unit 5A. The electric charge on the surface is erased by the charge removing unit 5B, and the sheet on which the toner image has been transferred is separated from the photoconductive drum 1 by the separating pawl 5C. Thereafter, the sheet is transported by an intermediate transport section 7B, and is heated and pressed by the fixing unit 8, so that the toner image is fixed to the sheet. The sheet having subjected to the fixing process is ejected from an ejection section 7C and is outputted to the sheet finisher 20.

On the other hand, a developer remaining on the surface of the photoconductive drum 1 is removed by the cleaning unit 6 at the downstream side of the separating pawl 5C, and preparation is made for next image formation.

In the case where duplex printing is performed, the sheet on the surface of which the toner image has been fixed is branched from the normal ejection path by a transport path switching plate 7D, is switched back in a reversal transport section 7E, and is turned upside down. A print process similar to the one-side printing is performed on the back side of the reversed sheet, and the sheet is outputted from the ejection unit 7C to the sheet finisher 20.

The sheet finisher 20 includes a saddle stitch process unit 30 and a sheet bundle placement section 40 in addition to a sorter section (not shown) to sort the sheets.

The saddle stitch process unit 30 performs a process (saddle stitch process) in which the center of a plurality of printed sheets ejected from the image forming unit 12 is stitched with staples, and then, folding is performed to form a booklet.

The booklet subjected to the saddle stitch process by the saddle stitch process unit 30 is outputted to the sheet bundle placement section 40, and the bound booklet is finally placed thereon.

Figure 3:
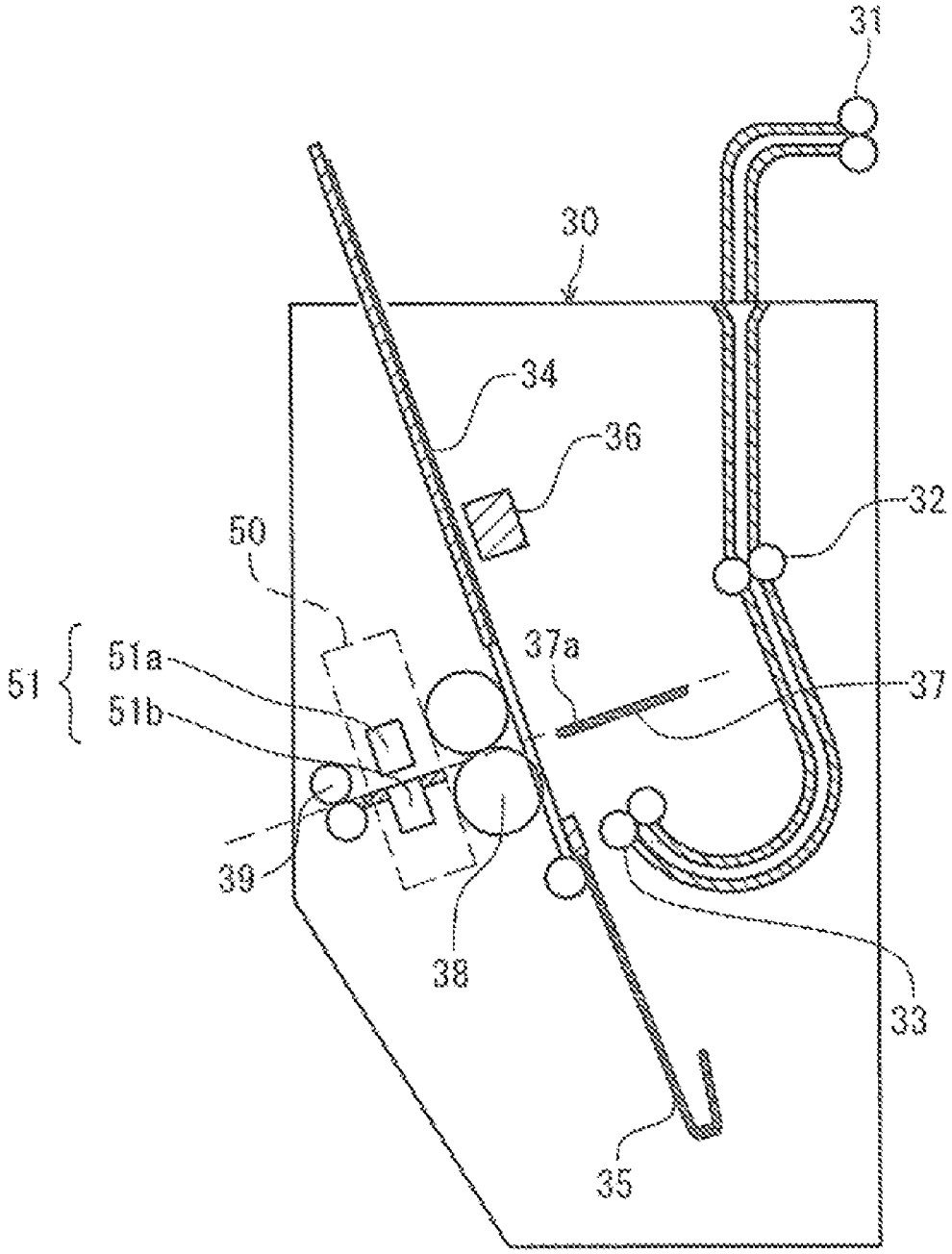
FIG. 3 is a sectional view showing a structural example of a saddle stitch process unit.

FIG. 3 is a sectional view showing a detailed structural example of the saddle stitch process unit 30.

In the saddle stitch process unit 30, the sheet ejected from the ejection section 7C of the image forming unit 12 is received by an inlet roller pair 31 and is delivered to an intermediate roller pair 32. The intermediate roller pair 32 delivers the sheet to an outlet roller pair 33. The outlet roller pair 33 sends the sheet to a standing tray 34 having an inclined placement surface. The leading edge of the sheet is directed to the upper part of the inclination of the standing tray 34.

A stacker 35 is provided below the standing tray 34, and receives the lower edge of the sheet which is switched back and falls from the upper part of the inclination of the standing tray 34.

A stapler (saddle stitch unit) 36 is provided at the middle of the standing tray 34. In the case where the saddle stitch process (stapling) is performed on the sheet bundle, the position of the stacker 35 is adjusted so that the position of the sheet bundle to be stapled (the center of the sheet bundle in the up-and-down direction) faces the stapler 36.

When the sheet bundle is stapled by the stapler 34, next, the stacker 35 descends until the position of the sheet bundle where a fold line is to be formed (the center of the sheet bundle in the up-and-down direction and the position where the staples are inserted) comes to the front of a fold blade 37.

When the position where the fold line is to be formed comes to the front of the fold blade 37, a leading edge 37*a* of the fold blade 37 pushes a surface which becomes an inner surface after the sheet bundle is folded.

A fold roller pair 38 is provided ahead of the fold blade 37 in the traveling direction. The sheet bundle pushed by the fold blade 37 is rolled into a nip of the fold roller pair 38, and the fold line is formed at the center of the sheet bundle. Incidentally, the fold blade 37 and the fold roller pair 38 constitute a fold unit.

The sheet bundle on which the fold line has been formed by the fold roller pair 38 is transported to a fold reinforcing unit 50 provided at the downstream side thereof. The sheet bundle transported to the fold reinforcing unit 50 is temporarily stopped there.

The fold reinforcing unit 50 includes a reinforce roller pair 51 (an upper roller (second roller) 51*a* and a lower roller (first roller) 51*b*). The reinforce roller pair 51 moves in the direction (direction along the line of the fold line) orthogonal to the transport direction of the sheet bundle while applying pressure to the fold line, and reinforces the fold line.

The sheet bundle whose fold line has been reinforced by the fold reinforcing unit 50 again starts to be transported, is pulled by an eject roller pair 39 and is outputted to the sheet bundle placement section 40, and the sheet bundle (booklet) subjected to the saddle stitch process is placed on the sheet bundle placement section 40.

The embodiment of the invention has features mainly in the structure, function, operation and the like of the fold reinforcing unit 50, and hereinafter, the structure, function, operation and the like of the fold reinforcing unit 50 will be described in detail.

(2) Structure and Operation of the Fold Reinforcing Unit

Figure 4:
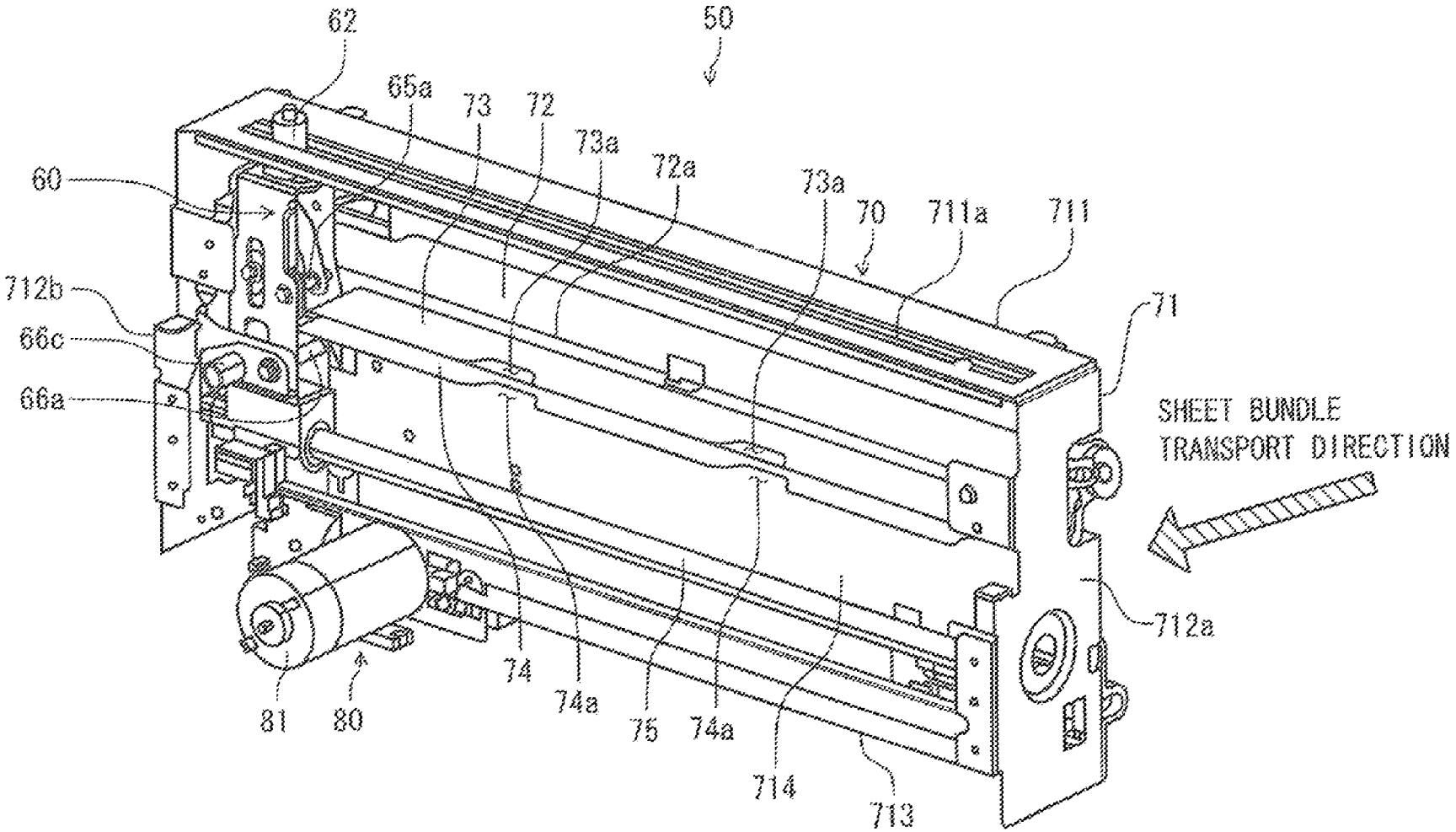
FIG. 4 is a perspective outer appearance view showing the whole structure of a fold reinforcing unit.

FIG. 4 is a perspective outer appearance view showing the whole structure of the fold reinforcing unit 50. The fold reinforcing unit 50 includes a reinforce roller unit 60 (hereinafter simply referred to as a roller unit 60), a support section 70 and a drive unit 80.

The roller unit 60 includes the reinforce roller pair 51, and the reinforce roller pair 51 nips and pressurizes the fold line of the sheet bundle pushed out from the upstream fold roller pair 38, and moves along the fold line to reinforce the fold line.

The support section 70 supports the roller unit 60 so that the roller unit can slide in the fold line direction, and includes a member of nipping the sheet bundle, a structural member of the whole fold reinforcing unit 50, and the like.

The drive unit 80 includes a drive motor 81, and drives the roller unit 60 along the fold line by the drive motor 81.

Figure 5B:
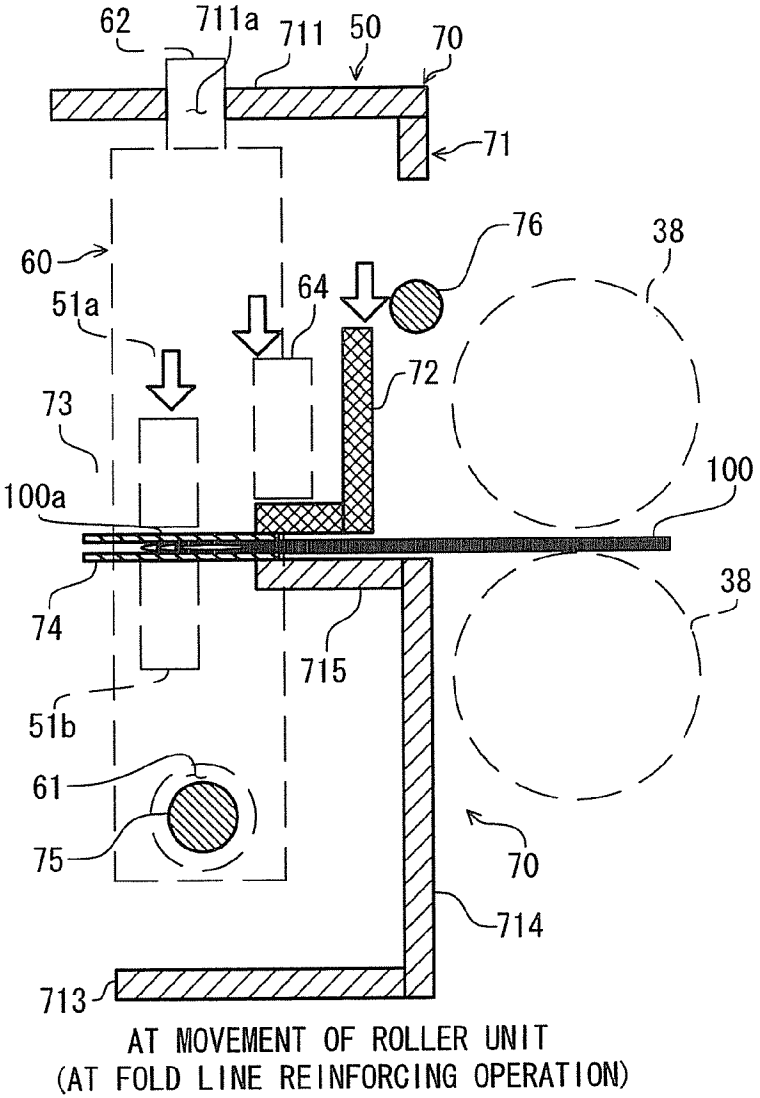
FIGS. 5A and 5B are schematic sectional views for mainly explaining a structure of a support section.
Figure 5A:
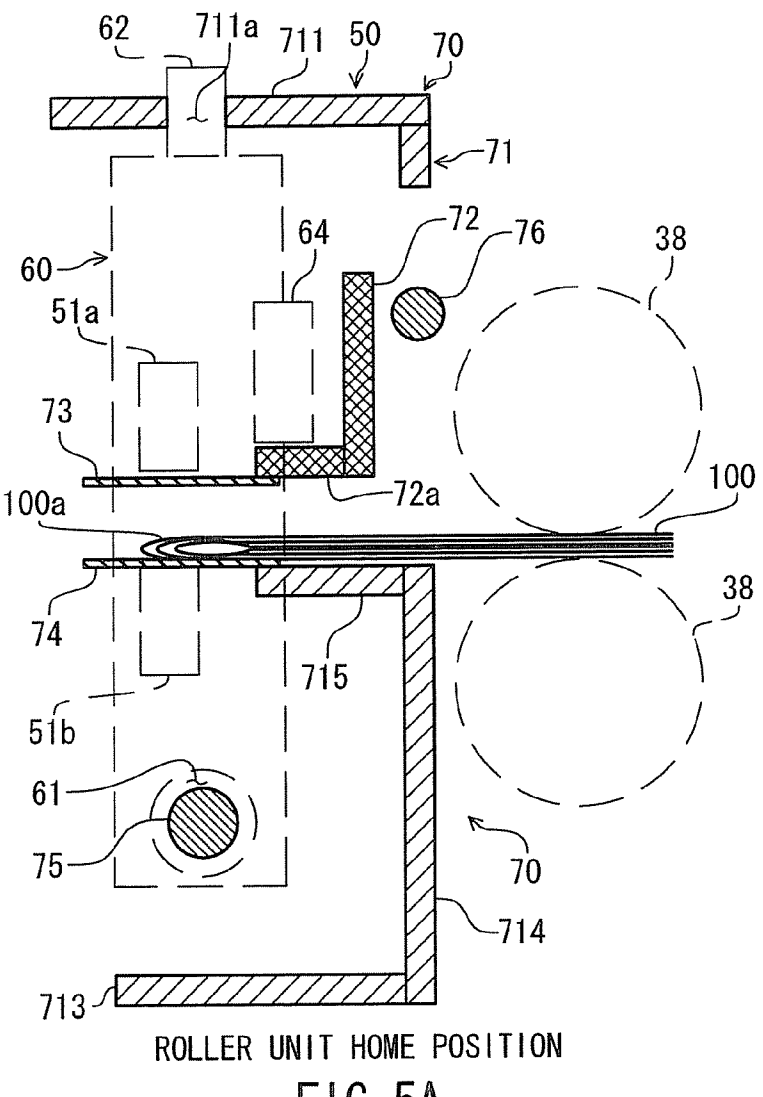

Among the roller unit 60, the support section 70 and the drive unit 80, the structure of the support section 70 will be first described by use of FIG. 4 and FIGS. 5A and 5B. FIGS. 5A and 5B are schematic sectional views for mainly explaining the structure of the support section 70. FIG. 5A is a sectional view at the time when the roller unit 60 is at a home position (standby position: left end position in FIG. 4), and FIG. 5B is a sectional view at the time when the roller unit 60 is moving (the fold line is reinforced).

The support section 70 includes a frame 71, and the frame 71 includes a top plate 711, right and left side plates 712*a* and 712*b*, a bottom plate 713, a back plate 714, a sheet bundle placement table (first nip plate) 715 (see FIG. 5A, FIG. 5B, etc.) and the like.

The top plate 711 is provided with a support hole 711*a* extending in the longitudinal direction.

Besides, a support shaft 75 to support the roller unit 60, a transport guide 72 having an L-shaped section, a drive shaft 76 (see FIG. 5A, FIG. 5B, etc.) to drive the transport guide 72 in the up-and-down direction and the like are provided between both the side plates 712*a* and 712*b*.

A band-like flexible member (second flexible member) 73 formed of a film-like resin member of polyethylene terephthalate (PET) or the like is extended from a bottom plate (second nip plate) 72*a* of the transport guide 72. A similar flexible member (first flexible member) 74 is extended also from the sheet placement table (first nip plate) 715.

The sheet bundle placement table (first nip plate) 715, the flexible member (first flexible member) 74, the bottom plate (second nip plate) 72*a* of the transport guide 72, and the flexible member (second flexible member) 73 constitute a nipunit.

As shown in FIG. 5A and FIG. 5B, a fold line 100*a* of a sheet bundle 100 is nipped between the flexible members 73 and 74, and is pressed by the reinforce roller pair 51 (the upper roller 51*a* and the lower roller 51*b*) through the flexible members 73 and 74, and the fold line is reinforced. The occurrence of a scratch or a wrinkle in the fold line and in the vicinity thereof is prevented through the flexible members 73 and 74.

Incidentally, cuts 73*a* and 74*b* are provided at the leading ends of the flexible members 73 and 74. These cuts 73*a* and 74*b* are provided at positions corresponding to positions of staples of the fold line, and prevent the flexible members 73 and 74 from being damaged by the staples.

As described later, a through hole 61 through which the support shaft 75 passes is provided in the lower part of the roller unit 60. Besides, a support roller 62 for keeping the attitude is provided in the upper part of the roller unit 60, and the support roller 62 is moved along the support hole 711*a* provided in the top plate 711.

The position (except for a position change in the movement direction) of the roller unit 60 and the attitude of three-axis are regulated by the support shaft 75 and the through hole 61, and the support hole 711*a* and the support roller 62, and are kept constant also during the movement of the roller unit 60.

Figure 6:
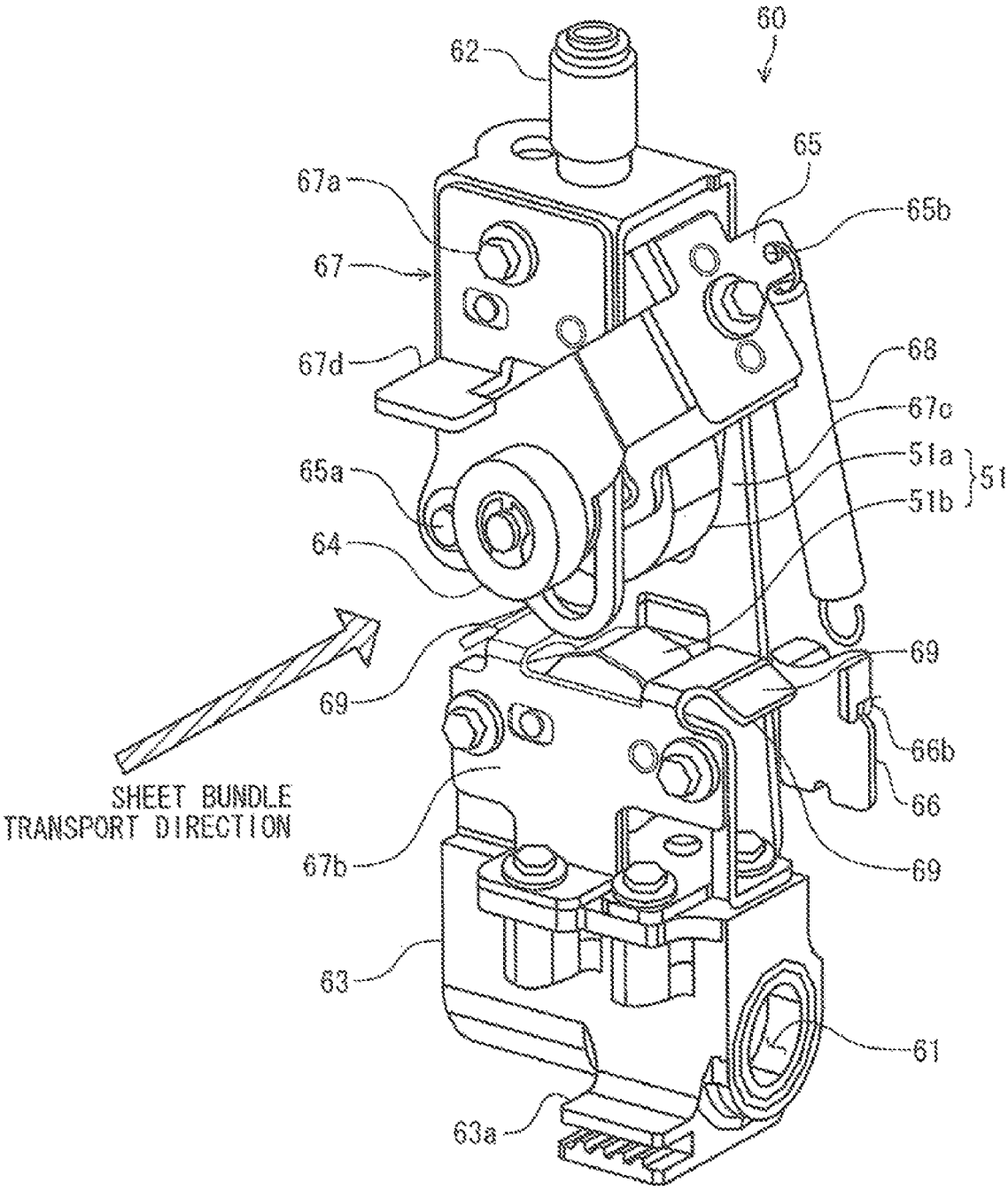
FIG. 6 is a perspective outer appearance view showing a structure of a roller unit.

Next, the structure of the roller unit 60 will be described. FIG. 6 is a perspective outer appearance view showing a structural example of the roller unit 60, and is a view seen from the sheet bundle sending source direction (direction opposite to FIG. 4).

The roller unit 60 is the unit incorporating the reinforce roller pair 51, and includes a unit support section 63 that is positioned at the lower part and is provided with the through hole 61, and a unit frame 67 fixed to the upper part of the unit support section 63.

In the unit frame 67, an upper frame 67*a* having a hollow section and a lower frame 67*b* having a hollow section are fixed and coupled by a frame plate 67*c*.

Besides, the roller unit 60 includes an upper link member (second link member) 65 and a lower link member (first link member) 66, and both are spring coupled by a spring 68. One end of the spring 68 is engaged with a hook hole 65*b* of the upper link member 65, and the other end of the spring 68 is engaged with a cut part 66*b* of the lower link member 66. Although FIG. 6 shows the spring 68 in a free state in which the other end of the spring 68 is released from the cut part 66*b*, in the state where the other end of the spring 68 is actually engaged with the cut part 66*b*, the pulling force of the spring 68 is applied between the upper link member 65 and the lower link member 66.

The lower roller 51*b* as one of the reinforce roller pair 51 is contained in the hollow section of the lower frame 67*b*. The lower roller 51*b* is freely rotatably supported around a lower roller shaft (not shown) fixed to the lower frame 67*b*.

The lower link member 66 is rotatably coupled to the side of the lower frame 67*b* through a lower link shaft 66*a* (see FIG. 4) fixed to the lower frame 67*b*.

The upper roller 51*a* as one of the reinforce roller pair 51 is contained in the hollow section of the upper frame 67*a*. The upper roller 51*a* is freely rotatably supported around an upper roller shaft (not shown) fixed to the upper link member 65 (not the upper frame 67*a*).

The rotation shaft (lower roller shaft) of the lower roller 51*b* is fixed to the lower frame 67*b* (that is, fixed to the unit frame 67), and even if the roller unit 60 is moved, the position of the lower roller 51*b* is not changed in the up-and-down direction. An adjustment is made so that the position of the upper end of the lower roller 51*b* becomes the same as the position of the flexible member 74, and when the roller unit 60 is moved, the lower roller 51*b* comes in contact with the lower surface of the flexible member 74 and is rotated.

On the other hand, the upper roller shaft of the roller 51*a* is fixed to the upper link member 65. When the roller unit 60 is separated from the home position and starts to move, the upper link member 65 is pulled by the spring 68, and starts to rotate downward around the upper link shaft 65*a*. By this rotation, the upper roller 51*a* rotatably attached to the upper link member 65 starts to descend, and is moved to a position where it comes in contact with the lower roller 51*b*. The press force caused by the pulling force of the spring 68 is mutually exerted between the upper roller 51*a* and the lower roller 51*b*. Actually, since the sheet bundle is nipped between the upper roller 51*a* and the lower roller 51*b* through the flexible members 73 and 74, the fold line of the sheet bundle is reinforced by the press force between the upper roller 51*a* and the lower roller 51*b*.

Figure 7:
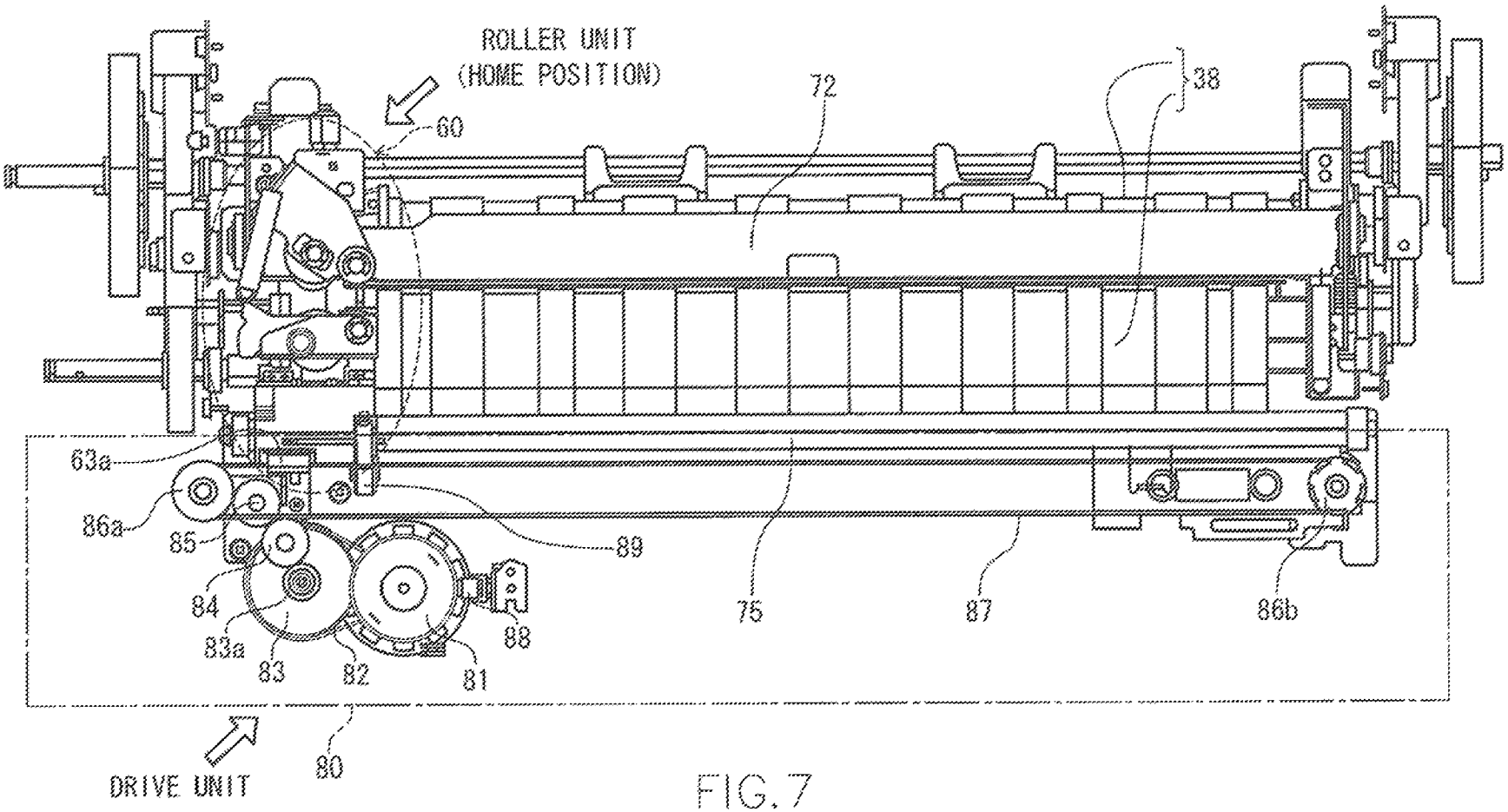
FIG. 7 is a view of the fold reinforcing unit seen from the transport destination of a sheet bundle.

Next, a structure of the drive unit 80 will be described. FIG. 7 is a view showing a structural example of the drive unit 80. FIG. 7 is a view seen in the direction from a transport destination of a sheet bundle to a transport source, and also shows the roller unit 60 at the home position, the fold roller pair 38 and the drive mechanism of the fold roller pair 38. The illustration of the structural member of the support section 70 is partially omitted for convenience of explanation.

The drive unit 80 includes a drive motor 81 which is only one drive source of the fold reinforcing unit 50. The drive motor 81 is a DC motor, and the rotation direction and rotation speed can be controlled from outside.

The drive force of the drive motor 81 is transmitted to a pulley 83 through a motor belt 82, and is further transmitted from the pulley 83 to a drive side pulley 86*a* through a gear 84 and a gear 85. On the other hand, a unit drive belt 87 is stretched between the drive side pulley 86*a* and a driven side pulley 86*b*. The unit drive belt 87 is moved between the drive side pulley 86*a* and the driven side pulley 86*b* by the drive force of the drive motor 81.

A rack is formed on the surface of the unit drive belt 87, and the rack is engaged with teeth of a fit section 63*a* (see FIG. 6) provided at the lower part of the roller unit 60, so that the roller unit 60 can be certainly moved without sliding in the fold line direction. The movement direction of the unit drive belt 87 can be changed by reversing the rotation direction of the drive motor 81, and the roller unit 60 can be reciprocated.

The movement amount and movement speed of the unit drive belt 87, that is, the movement amount and movement speed of the roller unit 60 can be controlled by rotation control of the drive motor 81. The rotation amount and rotation speed of the drive motor 81 is detected by a train of pulse signals outputted from an encoder sensor 88 disposed near the drive motor 81, and the rotation control of the drive motor 81 is performed based on the detected rotation amount and rotation speed.

The drive motor 81 may be constructed of a pulse motor. In this case, the rotation speed can be detected by counting the pulses directly outputted from the drive motor 81.

Figure 8:
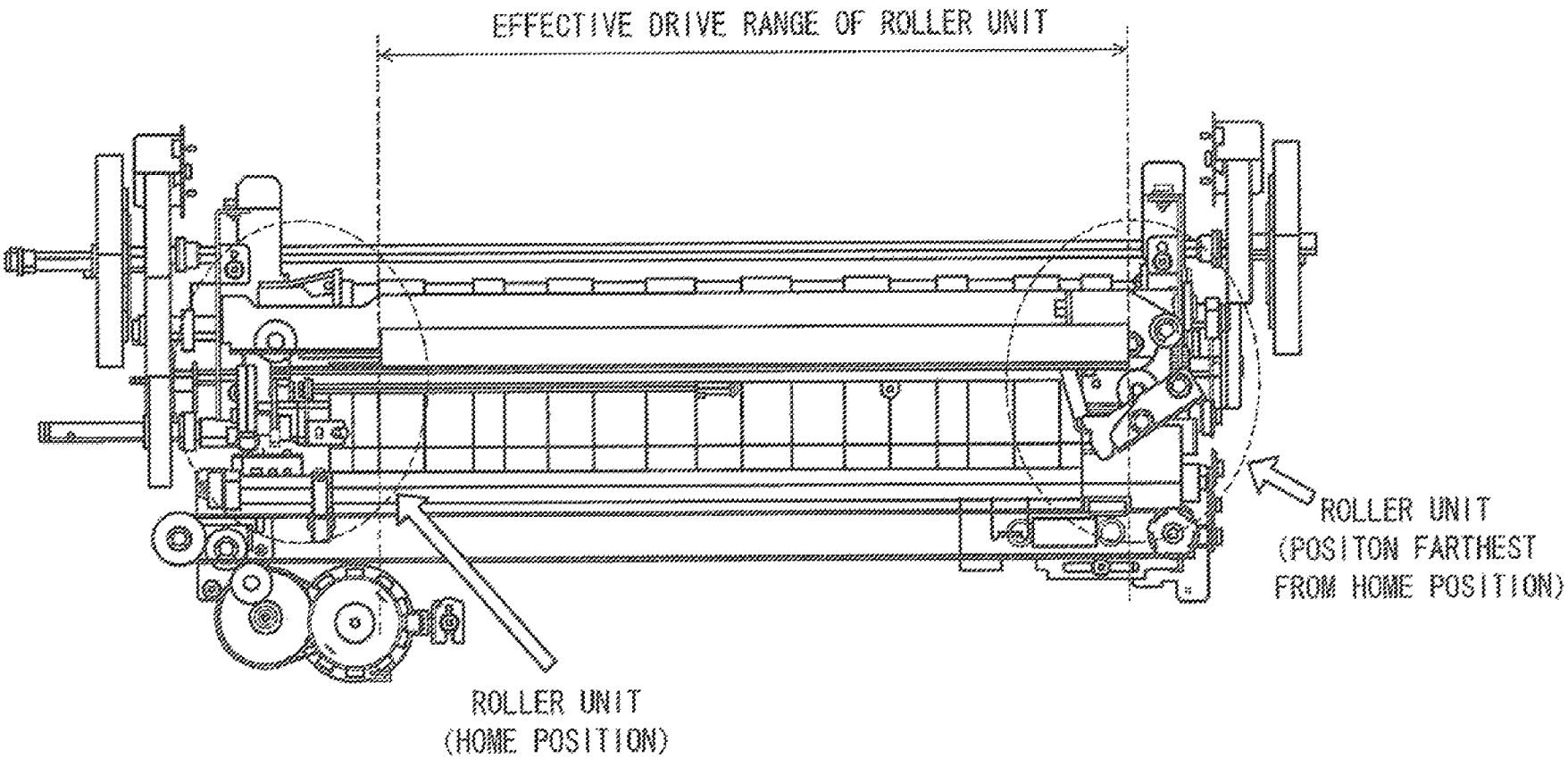
FIG. 8 is a view for explaining an effective drive range of the roller unit.

FIG. 8 is a view showing a relation between the effective drive range of the roller unit 60 and the width of a processable maximum sheet size (for example, A3 size). As shown in FIG. 8, the home position of the roller unit 60 is set at a position where even the sheet bundle of the processable maximum size does not interfere. On the other hand, the position farthest from the home position of the roller unit 60 is set at the farthest position within the range where the nip of the reinforce roller pair 51 does not pass through the end of the sheet bundle of the processable maximum size.

The roller unit 60 starts movement to be separated from the home position, moves along the fold line while reinforcing the fold line, and is once stopped at the end of the sheet bundle at the opposite side to the home position. Thereafter, the roller unit moves on the return path while continuously reinforcing the fold line, and is returned to the home position.

The position where the roller unit is once stopped at the end of the sheet bundle at the opposite side to the home position varies according to the sheet size, and the once stopped position is determined based on the information of the sheet size.

In the fold reinforcing unit 50, in addition to the movement of the roller unit 60 in the fold line direction, the up-and-down drive of the upper roller 51*a* in the inside of the roller unit 60 and the up-and-down drive of the transport guide 72 are also performed, and the drive source of all these up-and-down drives is the drive motor 81. That is, all the drive operations of the fold reinforcing unit 50 are performed by the single drive motor 81. Hereinafter, the mechanism of the up-and-down drive of the upper roller 51*a* and the mechanism of the up-and-down drive of the transport guide 72 will be described in sequence.

Figure 9:
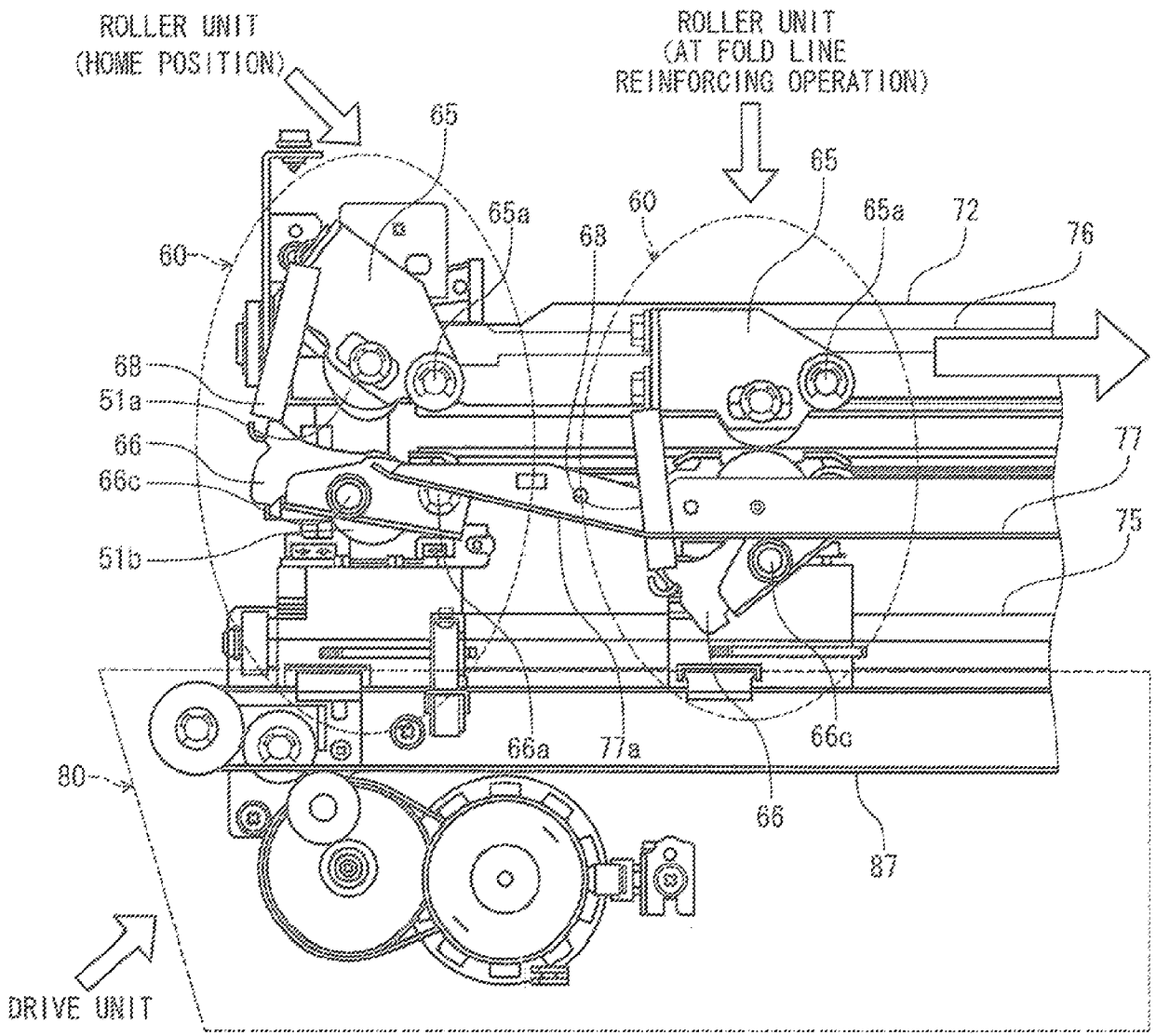
FIG. 9 is a first view for explaining the mechanism of up-and-down driving of an upper roller.
Figure 10:
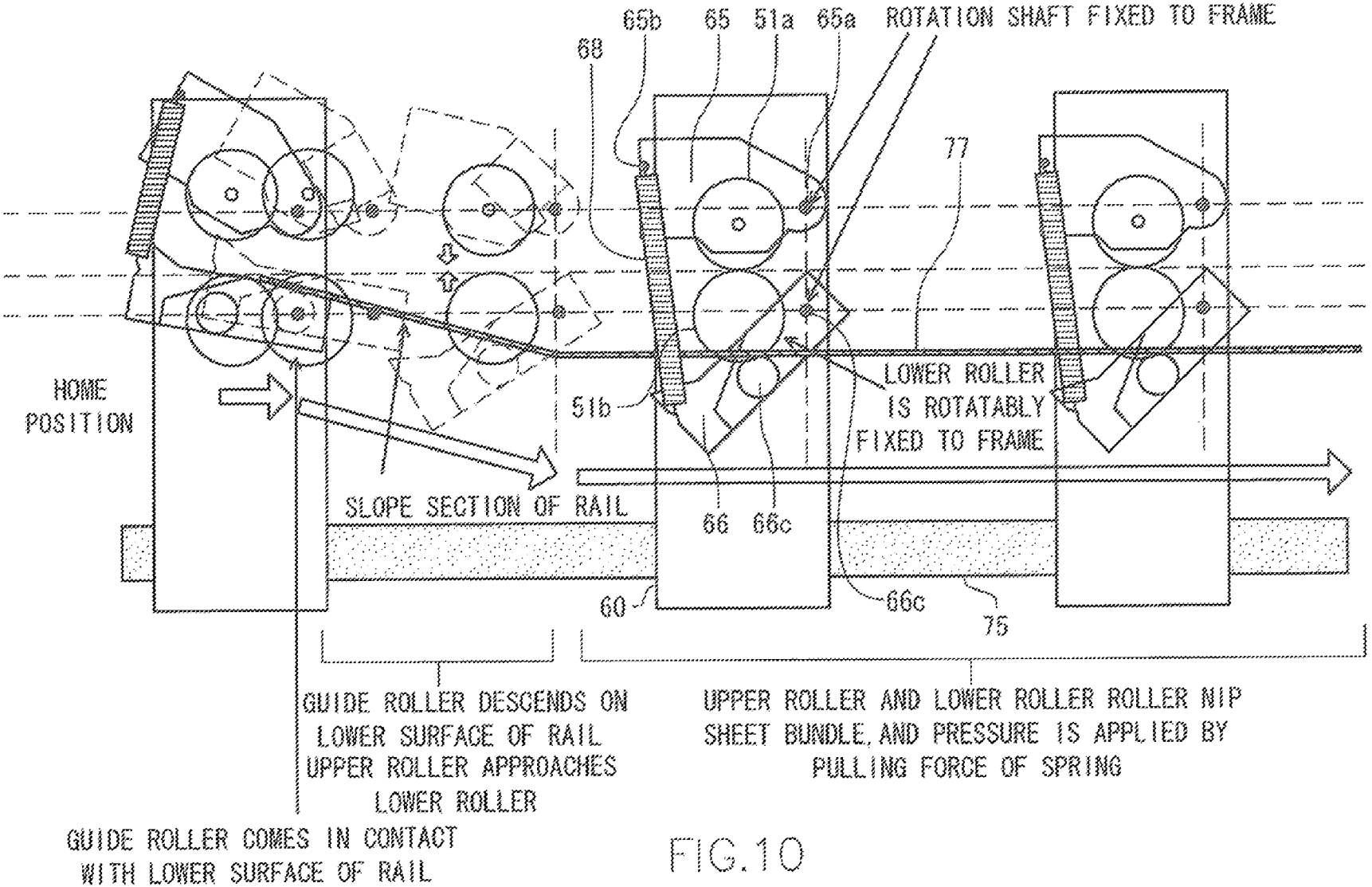
FIG. 10 is a second view for explaining the mechanism of up-and-down driving of the upper roller.

FIG. 9 and FIG. 10 are views for explaining the mechanism of the up-and-down drive of the upper roller 51*a*. As described before, the upper link member 65 and the lower link member 66 of the roller unit 60 are spring coupled by the spring 68 at the posit ions farthest from the respective rotation shafts (65*a*, 66*a*). Besides, the lower link member 66 is provided with a freely rotating guide roller 66*c* (see FIG. 4, etc.).

On the other hand, as shown in FIG. 9, the support section 70 includes a guide rail 77 having an L-shaped section. The guide rail 77 has an inclined section 77*a* in the vicinity of the home position, and is, except for the inclined section 77*a*, parallel to the fold line direction of the sheet bundle.

When the roller unit 60 is driven by the drive belt 87 and is separated from the home position, as shown in FIG. 10, the guide roller 66*c* comes in contact with the bottom of the inclined section 77*a* of the guide rail 77 before long. Thereafter, the guide roller 66*c* descends along the bottom of the inclined section 77*a*. As the guide roller 66*c* descends, the lower link member 66 is rotated around the lower link shaft 66*a* in the counterclockwise direction in FIG. 10. Besides, the upper link member 65 is also pulled by the spring 68 and is rotated around the upper link shaft 65*b* in the counterclockwise direction. As a result, the upper roller 51*a* between the upper link shaft 65*b* and the hook hole 65*b* of the spring 68 gradually descends while the roller unit 60 moves on the inclined section 77*a*, and the interval between the upper roller 51*a* and the lower roller 51*b* is gradually shortened. Then, the upper roller 51*a* and the lower roller 51*b* come in contact with each other in the vicinity of an area where the inclined section 77*a* is terminated. At this time, a pressure (pressing force) to press each other is exerted between the upper roller 51*a* and the lower roller 51*b*. The pressing force is based on the pulling force of the spring 68.

In a horizontal area (that is, the effective drive area) of the guide rail 77, the upper roller 51*a* and the lower roller 51*b* apply the pressure to the fold line of the sheet bundle and reinforce the fold line while keeping the pressing force.

Next, the mechanism of the up-and-down drive of the transport guide 72 will be described. As shown in FIG. 5A, when the roller unit 60 is at the home position, the transport guide 72 is raised upward, and the sheet bundle 100 is transported from an opening between the bottom plate 72*a* of the transport guide 72 and the sheet bundle placement table 715. On the other hand, as shown in FIG. 5B, when the roller unit 60 is moved into the effective movement range and is performing the fold line reinforcing operation, the transport guide 72 descends and nips the sheet bundle.

Figure 11:
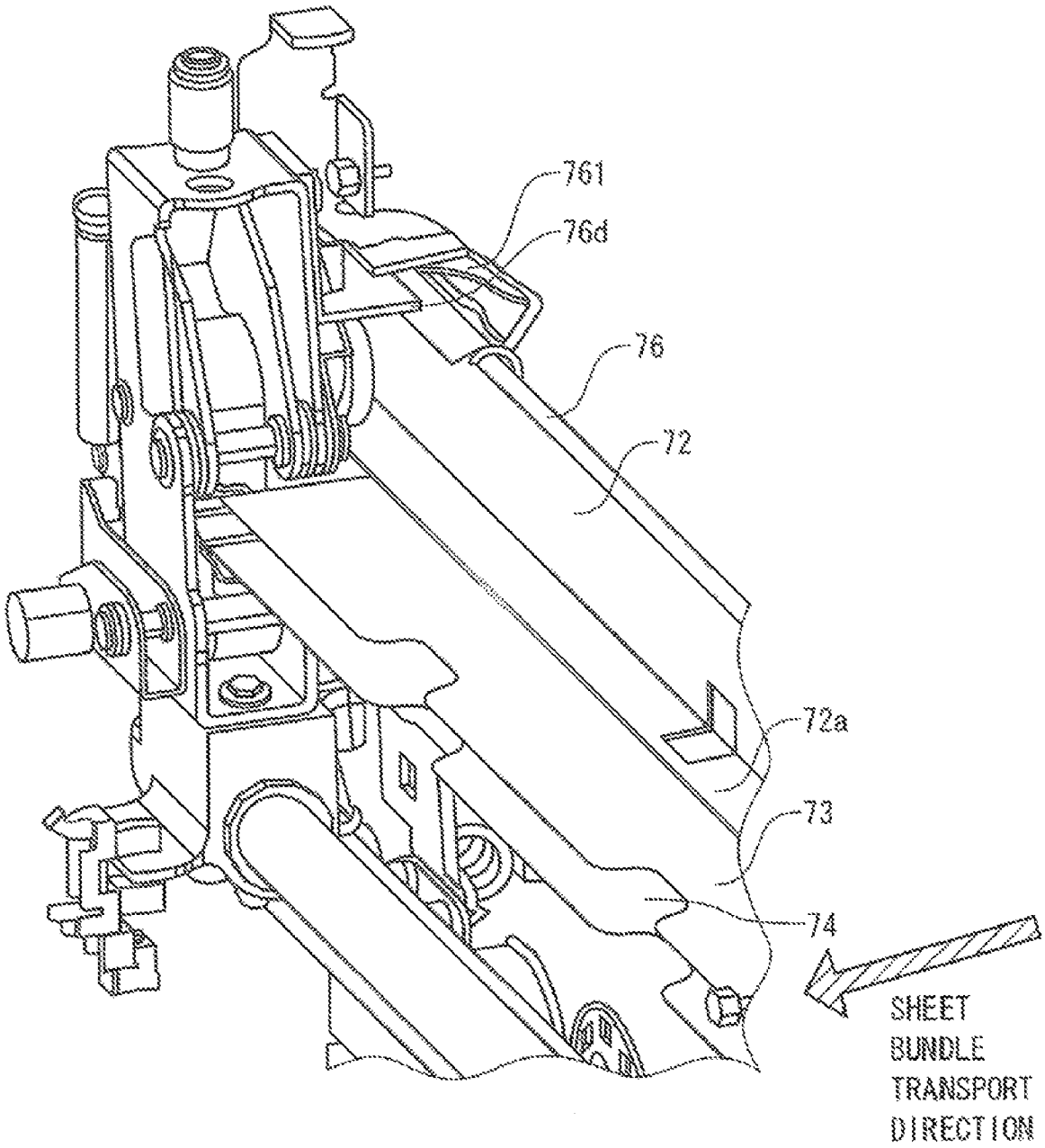
FIG. 11 is a first view showing a drive structure used for up-and-down driving of a transport guide.
Figure 12:
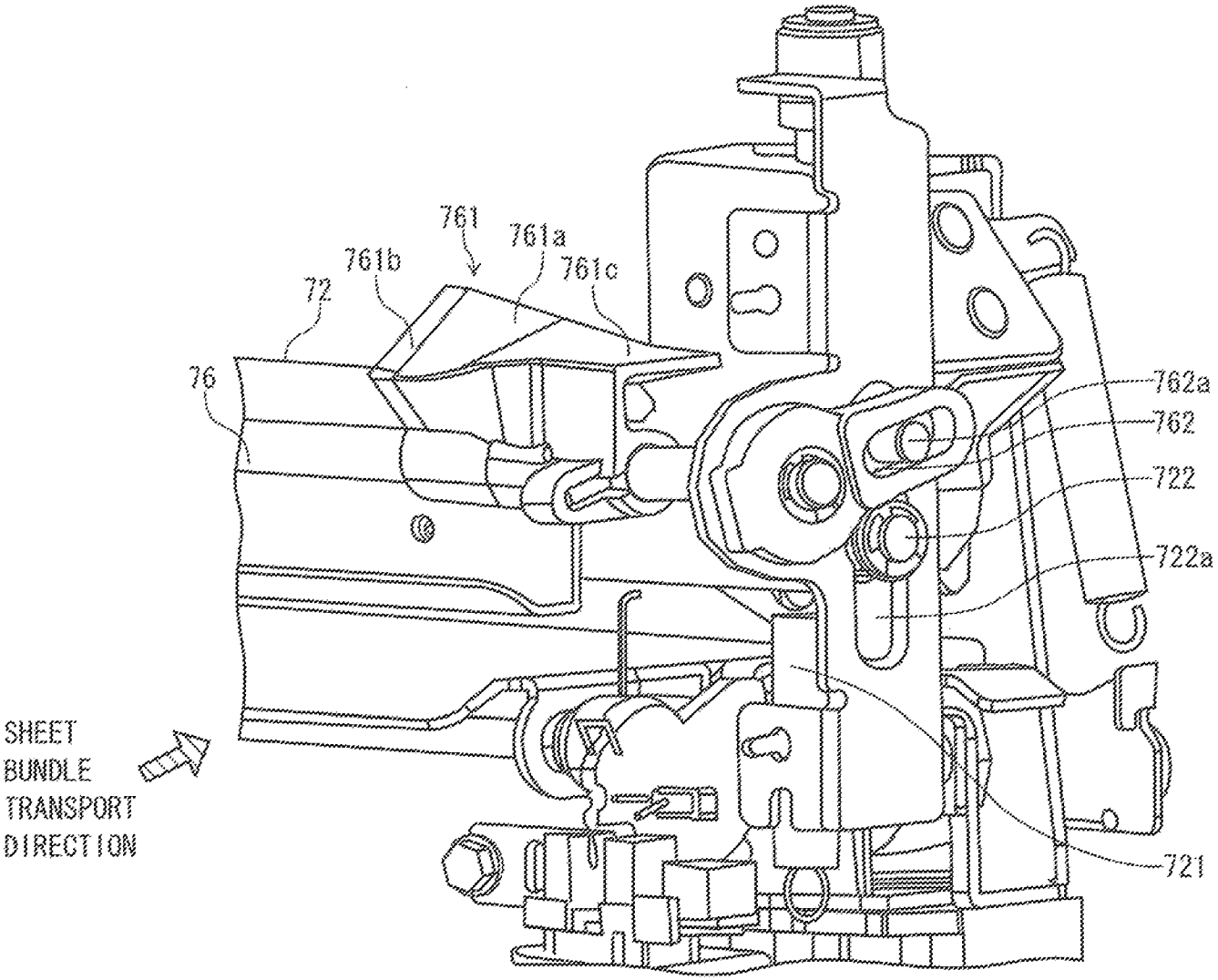
FIG. 12 is a second view showing the drive structure used for up-and-down driving of the transport guide.

FIG. 11 and FIG. 12 are views showing a drive structure used for the up-and-down drive of the transport guide 72.

As shown in FIG. 11 and FIG. 12, the drive shaft 76 used for the up-and-down drive of the transport guide 72 is disposed between the transport guide 72 and the fold roller pair 38. A cam member 761 is fixed to one end of the drive shaft 76 at the home position side.

As shown in FIG. 12, the cam member 761 includes a twisted section 761*a* formed into a shape of a twisted plate member, a horizontal section 761*c* continuous with the twisted section 761*a*, and a leading end section 761*b* at the opposite side to the horizontal section 761*c*.

Besides, a lever member 762 is fixed to the drive shaft 76 at the leading end of the cam member 761 at the home position side. A long hole 762*b* is provided in the leading end section of the lever member 762, and a lever roller 762*a* fixed to the end of the transport guide 72 is slidably inserted in the long hole 762*b*.

Besides, a bearing member 722 is fixed to the end of the transport guide 72, and the bearing member 722 is inserted in a long hole 722*a* formed in the unit frame 67 of the roller unit 60, and can slide in the up-and-down direction.

On the other hand, the end of the bottom plate 72*a* of the transport guide 72 at the home position side and the bottom plate 713 of the frame 71 are spring coupled by a transport guide spring 721, and the transport guide 72 is pulled downward (direction toward the bottom plate 713) by the pulling force of the transport guide spring 721.

Next, the movement of these drive structures will be described with reference to FIG. 13A to FIG. 13D.

Figure 13C:
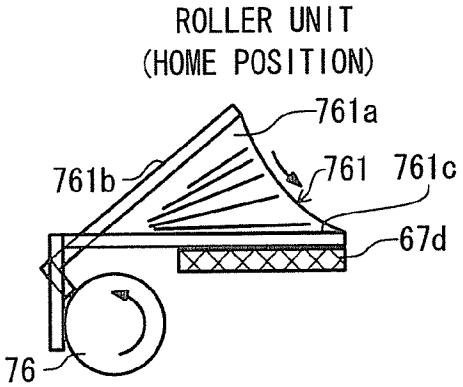
FIGS. 13A to 13D are views for schematically explaining the movement of an up-and-down drive structure of the transport guide.
Figure 13D:
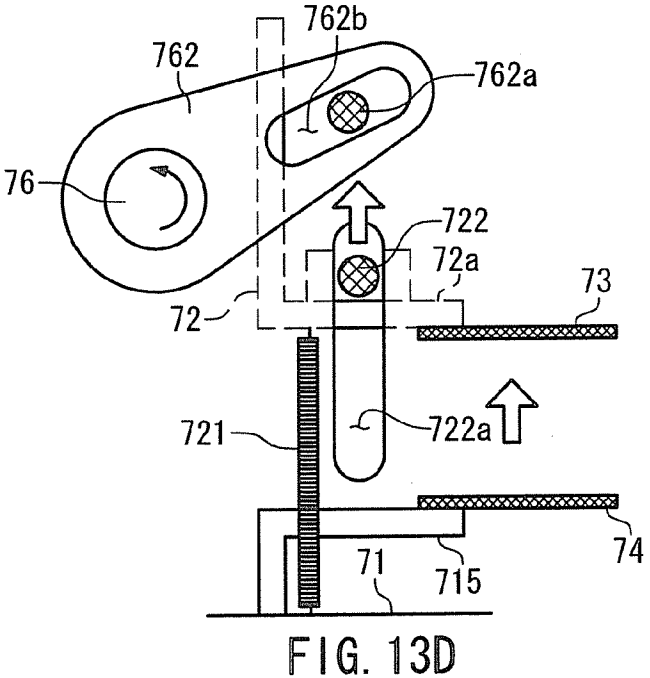
Figure 13A:
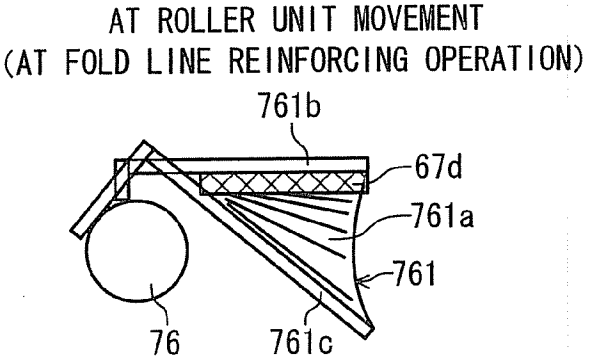
Figure 13B:
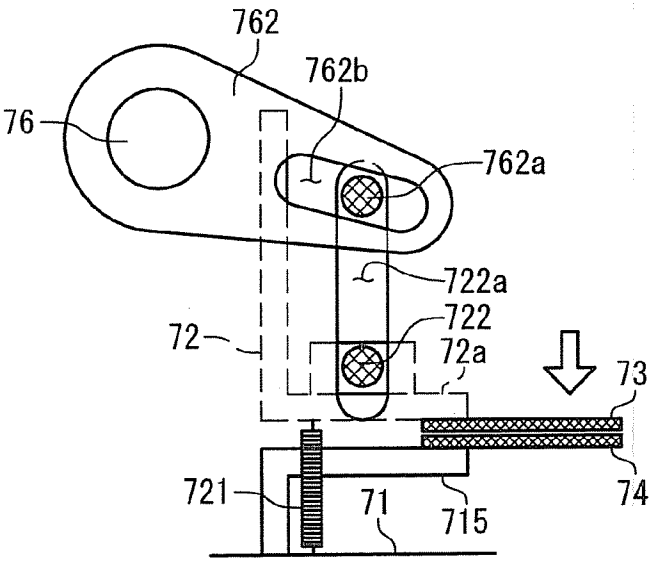

FIG. 13A and FIG. 13B are views of a state where the roller unit 60 is separated from the home position and is moved, that is, the fold line reinforcing operation is performed.

FIG. 13A is a view showing a positional relation between the cam member 761 fixed to the drive shaft 76 and a transport guide support table 67*d*. The roller unit 60 has the transport guide support table 67*d* horizontally extending from the unit frame 67 (see FIG. 11, FIG. 6). When the roller unit 60 is separated from the home position, the cam member 761 and the transport guide support table 67*d* are located at separate positions, and they do not interfere with each other.

On the other hand, at the fold line reinforcing operation, as shown in FIG. 13B, the transport guide 72 is pulled downward by the pulling force of the transport guide spring 721, and the bottom plate 72*a* (and the flexible member 73) of the transport guide 72 is pressed to the sheet bundle placement table 715 (and the flexible member 74) through the sheet bundle (not shown).

Incidentally, at this time, the bearing member 722 and the lever roller 762*a* fixed to the transport guide 72 are also pulled downward, and by this, the leading end of the lever member 762 is directed slightly downward and is stopped. Besides, as shown in FIG. 13A, the leading end section 761*b* of the cam member 761 is stopped at a position where it becomes parallel to the transport guide support table 67*d* of the roller unit 60.

When the roller unit 60 reaches the opposite side of the home position, and is again returned to the vicinity of the home position, the transport guide support table 67*d* of the roller unit 60 first comes in contact with the lower surface of the leading end section 761*b* of the cam member 761.

Thereafter, when the roller unit 60 is further moved to the home position side, the transport guide support table 67*d* moves while sliding on the lower surface of the twisted section 761*a* of the cam member 761. At this time, an upward force is generated to the cam member 761 by the curve of the twisted section 761*a*, and the drive shaft 76 fixed to the cam member 761 is rotated (rotated in the counterclockwise direction in FIG. 13C).

By the rotation of the drive shaft 76, the lever member 762 is also rotated in the same direction, and the leading end of the lever member 762 is raised. As a result, the lever roller 762*a* inserted in the long hole 762*b* of the lever member 762 is pulled upward, and the transport guide 72 fixed to the lever roller 762*a* is also moved upward against the pulling force of the transport guide spring 721.

When the roller unit 60 is completely returned to the home position, the transport guide support table 67*d* of the roller unit 60 passes through the twisted section 761*a* of the cam member 761, reaches the horizontal section 761*c* and is stopped here.

A force to cause downward movement is exerted on the transport guide 72 by the pulling force of the transport guide spring 721. However, at the home position, since the horizontal section 761*c* of the cam member 761 is put on the upper surface of the transport guide support table 67*d*, it can not move downward. Thus, the drive shaft 76 and the lever member 762 are put in a state where the clockwise rotation is inhibited, and the lever roller 762*a* and the transport guide 72 fixed thereto can not move downward.

As stated above, when the roller unit 60 is at the home position, the transport guide 72 and the flexible member 73 are kept in a state where they are raised upward.

In this state, the sheet bundle whose fold line has been reinforced is pushed out by the rotation of the fold roller pair 38, and is transported to the sheet bundle placement section 40. Besides, a sheet bundle whose fold line is to be reinforced after this is transported so that the fold line is positioned between the flexible members 73 and 74 in this state.

When the roller unit 60 is separated from the home position in order to reinforce the fold line, a movement reverse to the above movement is performed. When the roller unit 60 starts to separate from the home position, the transport guide support table 67*d* of the roller unit 60 is shifted from the horizontal section 761*c* of the cam member 761 to the position of the twisted section 761*a*. The clockwise force caused by the pulling force of the transport guide spring 721 is exerted on the drive shaft 76, and the drive shaft is gradually rotated in the clockwise direction while the transport guide support table 67*d* moves on the curved section of the twisted section 761*a*. By this, the lever member 762 is also rotated in the clockwise direction, and the lever roller 762*a*, the bearing member 722 and the transport guide 72 fixed thereto also descend. Finally, the bottom plate 72*a* of the transport guide 72 and the flexible member 73 reach the sheet bundle, and the descending movement is stopped at the stage where the sheet bundle is pressed by the pulling force of the transport guide spring 721.

Up to here, the description has been made on the lateral movement of the roller unit 60 along the fold line of the sheet bundle, the up-and-down movement of the upper roller 51*a* in the roller unit 60, and the up-and-down movement of the transport guide 72, and these movements are roughly summarized as follows.

(a) When the roller unit 60 is at the home position, the transport guide 72 and the upper flexible member 73 are raised upward. Besides, the upper roller 51*a* in the roller unit 60 is also raised upward.

Incidentally, the positions of the sheet bundle placement table 715 and the lower flexible member 74 in the up-and-down direction are almost equal to the position of the nip of the fold roller pair 38, and are always constant irrespective of the movement of the roller unit 60. Similarly, the position of the lower roller 51*b* in the up-and-down direction in the roller unit 60 is always constant irrespective of the movement of the roller unit 60, and the position of the upper end of the lower roller 51*b* is set at almost the same position as the lower flexible member 74.

(b) When the roller unit 60 is at the home position, the sheet bundle is transported through the nip of the fold roller pair 38, and when the fold line reaches between the flexible members 73 and 74, the transport of the sheet bundle is once stopped.

(c) Here, the drive motor 81 is driven, the roller unit 60 starts the lateral movement by the unit drive belt 87, and starts to be separated from the home position.

(d) When the roller unit 60 is separated from the home position, the transport guide 72 and the upper flexible member 73 descend, and the sheet bundle is pressed by the bottom plate 72*a* of the transport guide 72 from above (the operation of FIG. 13A to FIG. 13D). The pressing force is the force caused by the pulling force of the transport guide spring 721. The descending operation of the transport guide 72 is completed before the roller unit 60 reaches the effective drive range, and the state is such that the fold line of the sheet bundle is nipped by the upper and the lower flexible members 73 and 74.

(e) On the other hand, when the roller unit 60 is separated from the home position, the upper roller 51*a* in the roller unit 60 also starts to descend. Then, the upper surface of the upper flexible member 73 whose descending operation is already completed is pressed (the operation of FIG. 10). At this time, the lower roller 51*b* exists at the lower surface of the lower flexible member 74, and the upper and the lower flexible members 73 and 74 are pressed by the upper roller 51*a* and the lower roller 51*b*. This pressing force is caused by the pulling force of the spring 68 in the roller unit 60.

(f) Thereafter, the roller unit 60 moves in accordance with the movement of the unit drive belt 87. When the roller unit 60 reaches the position of the sheet bundle, the upper roller 51*a* runs onto the sheet bundle through the upper flexible member 73, and moves along the fold line while pressing the fold line of the sheet bundle. When the roller unit 60 reaches the end at the opposite side to the home position, the movement of the unit drive belt 87 is reversed, and the roller unit moves on the return path along the fold line while pressing the fold line of the sheet bundle. Then, finally, it returns to the home position.

As described above, in the fold reinforcing unit 50 of the embodiment, since the sheet bundle is nipped by the reinforce roller pair 51 through the upper and the lower flexible members 73 and 74, the sheet is not turned up at the edge of the sheet bundle. Besides, since the reinforce roller pair 51 does not come in direct contact with the fold line, the fold line is not wrinkled or damaged.

Besides, since the structure is made such that the transport guide 72 which can be driven in the up-and-down direction is provided, and the transport guide 72 applies pressure to the sheet bundle and presses it, even if the reinforce roller pair 51 is moved along the fold line, the sheet bundle is not shifted in the lateral direction.

Hitherto, in order to prevent the shift of the sheet bundle in the lateral direction, a structure is proposed in which a stop member is provided at the edge of the sheet bundle, however, the position of the stop member must be changed according to the size of the sheet, and this is inconvenient.

On the other hand, in the embodiment of the present invention, since the structure is made such that the sheet bundle is pressed by the transport guide 72 having the width to sufficiently cover the width of the maximum sheet size (for example, A3 size), the lateral shift of the sheet bundle can be prevented irrespective of the sheet size.

Besides, the structure is made such that the fold reinforcing unit 50 of the embodiment includes the transport guide roller 64 to further press the transport guide 72. As shown in FIG. 6, the transport guide roller 64 is attached to the upper link member 65 of the roller unit 60. When the roller unit 60 is separated from the home position, the transport guide roller 64 descends similarly to the upper roller 51*a*, and presses the bottom plate 72*a* of the transport guide 72 from above (see FIG. 5A and FIG. 5B). The descending of the transport guide roller 64 is realized by the same mechanism as that of the descending of the upper roller 51*a*. The transport guide 72 is pressed by the transport guide roller 64 in addition to the pulling force of the transport guide sprig 721, and the prevention of the lateral shift of the sheet bundle is strengthened.

Here, a notable point is that in this embodiment, the three independent movements, that is, the lateral movement of the roller unit 60, the up-and-down movement of the upper roller 51*a* (and the transport guide roller 64) in the roller unit 60, and the up-and-down movement of the transport guide 72 are realized by the single drive source, that is, only the drive motor 81, not a plurality of independent drive sources. As a result, the number of drive motors is reduced, and a contribution is made to a reduction in cost and a reduction in electric power. Besides, when an attempt is made to realize the independent movements by a plurality of drive motors, it is necessary to synchronize the mutual movements, and a control circuit for that becomes complicated. On the other hand, in this embodiment, since the respective movements are realized by the single drive motor 81, a synchronization control circuit between drive motors is not required.

(3) Shape and Structure of the Reinforce Roller Pair and its Vicinity

Hitherto, it is general that each roller of a reinforce roller pair has a perfect circle shape. However, in the case where a fold line is reinforced by a perfectly circular roller pair, when a wrinkle once occurs in a nip, since a portion where the wrinkle is absorbed does not exist in the nip, there is a case where the wrinkle continuously occurs and gradually becomes large, and at the time of the end of the fold reinforcing process, the large wrinkle damages the sheet. In this embodiment, although the flexible members 73 and 74 are made to intervene between the sheet bundle and the reinforce roller pair 51 to prevent the occurrence of a wrinkle, it is conceivable that a wrinkle still occurs.

Besides, it is more effective to apply the pressure of the reinforcing process through a dot than through a surface.

Figure 14A:
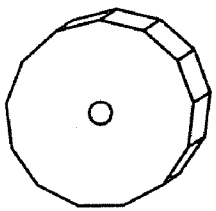
FIGS. 14A to 14C are views for exemplifying shapes of reinforce rollers.
Figure 14B:
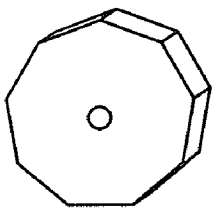
Figure 14C:
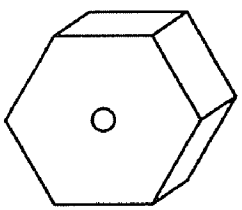

Then, in the reinforce roller pair 51 of the embodiment, the shape is made a polygon, not the pure perfect circle. FIG. 14A to FIG. 14C exemplify the shape of one roller of the polygonal reinforce roller pair 51 (see also the shape of the reinforce roller pair 51 in FIG. 6). The occurrence of a wrinkle is reduced by making the roller shape polygonal, and further, since a high pressure is applied to the fold line by the corner of the polygon, more effective reinforcement of the fold line becomes possible. Incidentally, although the number of angles of the polygon is not necessarily limited, from the viewpoint that the rotation movement function of the roller is not damaged, it is preferable that the polygon is a hexagon or higher polygon.

Figure 14D:
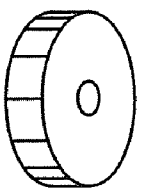

Besides, as exemplified in FIG. 14D, a structure may be made such that a plurality of grooves parallel to a rotation axis are formed on the surface of the roller. A generated wrinkle is absorbed in the portion of the groove and the continuous occurrence of wrinkles can be prevented.

Figure 14E:
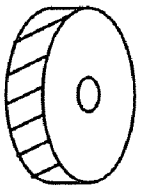
Figure 14F:
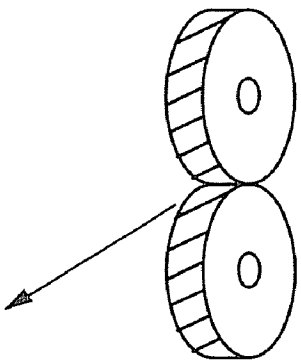
Figure 14G:
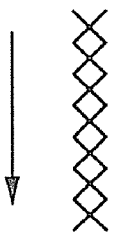

Besides, as exemplified in FIG. 14E, a structure may be made such that a plurality of oblique grooves are formed on the surface of the roller with respect to the rotation axis. In this case, as shown in FIG. 14F, when the grooves are formed so that the grooves of the rollers having the oblique grooves intersect with each other at the nip, as shown in FIG. 14G, the effect that the pressure is always applied through a point is obtained, and the fold line can be reinforced more intensely.

Incidentally, in two rollers constituting a roller pair, when one roller is made to have the shape shown in FIG. 14A to FIG. 14E and the other roller shape is made the perfect circle, almost the same effect can be obtained.

Besides, in this embodiment, as shown in FIG. 6, the guide member 69 is provided before and after the lower roller 51*b* in the transport direction. The guide member 69 is formed by bending a plate member, and has a horizontal section and an inclined section. The horizontal section is disposed near the lower roller 51*b*, and an adjustment is made so that the horizontal section has the same height as the upper end of the lower roller 51*b*. The inclined section is inclined downward from the horizontal section and extends.

As described above, even if the roller unit 60 is moved, the position of the lower roller 51*b* in the up-and-down direction is always constant. A position adjustment is made so that the movement is performed along the lower surface of the lower flexible member 74. However, when the end of the flexible member 73, 74 or the sheet bundle falls by the weight of the flexible member 73, 74 itself or the weight of the sheet bundle itself, these ends are abutted against a part lower than the upper end of the lower roller 51*b*, and there occurs a problem that the end of the flexible member 73, 74 or the sheet bundle is turned up by the movement of the lower roller 51*b*. Such a problem can occur also in the case where the up-and-down position adjustment of the roller unit 60 and the up-and-down position adjustment of the flexible member 73, 74 and the sheet bundle placement table 715 are insufficient.

The guide member 69 of the embodiment is provided in order to solve such a problem, and even in the case where the end of the flexible member 73, 74 or the sheet bundle is shifted from the height of the upper end of the lower roller 51*b* by the falling or the like, the end of the flexible member 73, 74 or the sheet bundle can be certainly guided by the inclined section of the guide member 69 to the upper end of the lower roller 51*b*, that is, the nip of the reinforce roller pair 51.

Figure 15:
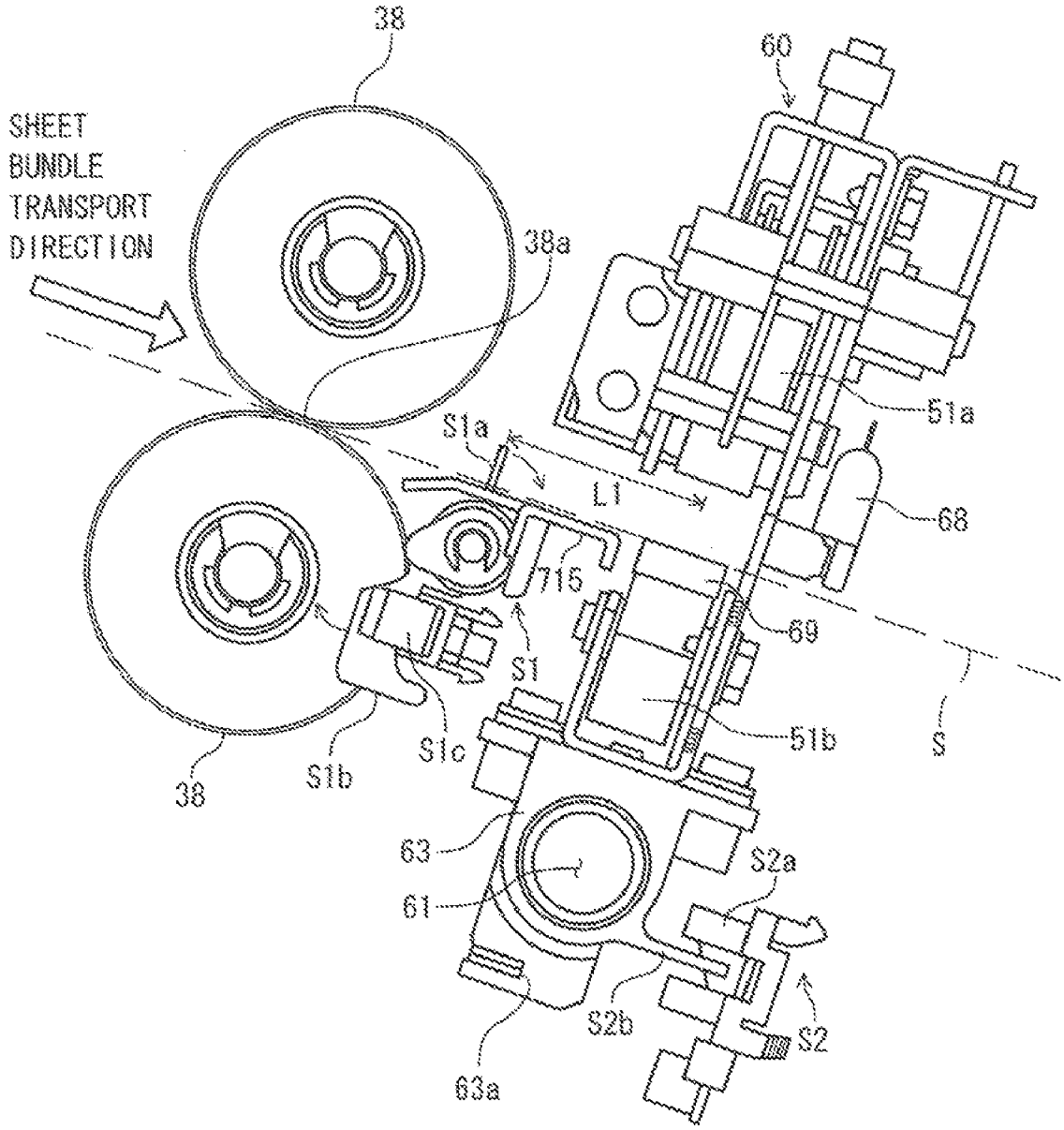
FIG. 15 is a view showing a relation among respective positions of a transport reference surface of a sheet bundle, a nip of a fold roller pair and an upper end of a lower roller.

FIG. 15 is a view showing a relation between a transport reference surface S (upper surface of the sheet bundle placement table 715) of the sheet bundle and each position of a nip 38*a* of the fold roller pair 38 and the upper end of the lower roller 51*b*. The transport reference surface S of the sheet bundle is indicated by a broken line.

The transport reference surface S of the sheet bundle is made coincident with the nip 38*a* of the fold roller pair 38, and is made coincident with the upper end of the lower roller 51*b*, so that the smooth transport of the sheet bundle becomes possible. Since the sheet bundle slightly falls by its own weight, the transport reference surface S may be lower by that amount than the nip 38*a* of the fold roller pair 38. By the same reason, the upper end of the lower roller 51*b* may be slightly lower than the transport reference surface S.

(4) Drive Control

Next, drive control of a sheet bundle in the transport direction and drive control of the roller unit 60 in the fold line direction (direction orthogonal to the transport direction of the sheet bundle) will be described.

The driving of the sheet bundle in the transport direction is performed by the fold roller motor (not shown) to rotate the fold roller pair 38. The control of the timing of the movement start and movement stop of the sheet bundle in the transport direction, the movement amount and the like is performed by controlling the start, stop and rotation amount of the rotation of the fold roller motor.

The On and Off information of an eject transport sensor S1 is used for the drive control of the sheet bundle in the transport direction. As shown in FIG. 15, the eject transport sensor S1 includes, for example, a lever S1*a* provided on the transport reference surface S, a light-shielding plate S1*b*, and a photosensor S1*c*.

In the state where there is no sheet bundle on the sheet bundle placement table 715, the lever S1*a* stands upright, and the light-shielding plate S1*b* coupled to the lever S1*a* shields the light path in the photosensor S1*c*. This state is a state where the eject transport sensor S1 is off. When the leading edge of the sheet bundle passes through the lever S1*a*, the lever S1*a* falls in the transport direction, and by this, the light-shielding plate S1*b* disappears from the light path in the photosensor S1*c*. This state is a state where the eject transport sensor S1 is on. When the fold line reinforcing process of the sheet bundle is ended, the sheet bundle is further moved in the transport direction, and when the trailing edge of the sheet bundle passes through the position of the lever S1*a*, the lever S1*a* returns to the upright state, and the eject transport sensor S1 is again put in the off state.

On the other hand, with respect to the driving of the roller unit 60 in the fold line direction, the control of the timing of movement start and movement stop of the roller unit 60, the movement amount, the movement speed and the like is performed by controlling the start, stop and rotation amount of the rotation of the drive motor 81.

The On and Off information of a home position sensor S2 is used for the drive control of the roller unit 60. For example, as shown in FIG. 15, the home position sensor S2 includes a photosensor S2*a* set at a position of a home position, and a light-shielding plate S2*b* provided at the lower part of the roller unit 60.

When the roller unit 60 is at the position of the home position, the light-shielding plate S2*b* shields the light path of the photosensor S2*a*. This state is a state where the home position sensor S2 is on. When the roller unit 60 is separated from the home position, since the light-shielding plate S2*b* is also moved together with the roller unit 60, the light path of the photosensor S2*a* is opened. This state is a state where the home position sensor S2 is off.

Figure 16:
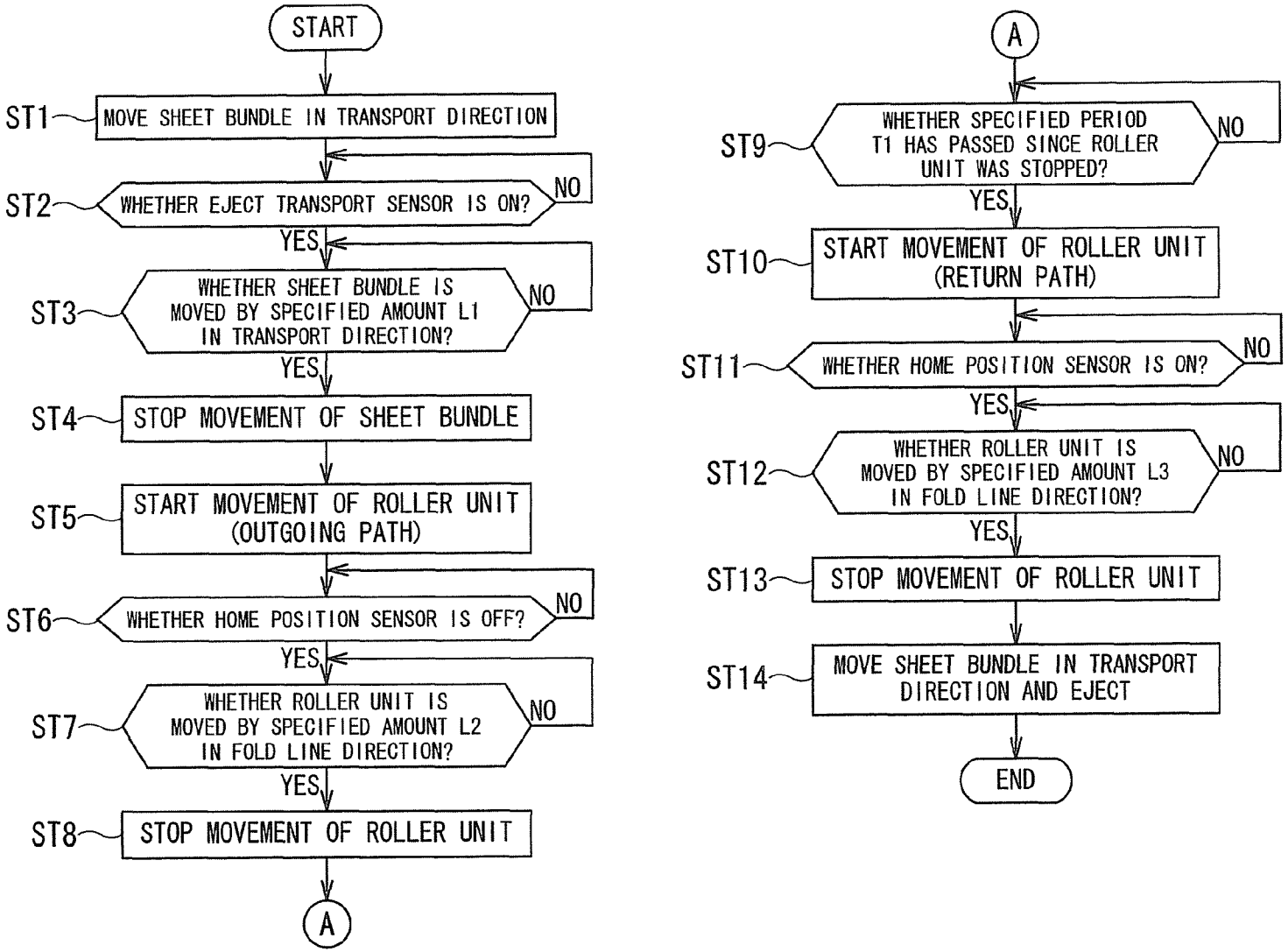
FIG. 16 is a flowchart showing an example of a process of drive control of a sheet bundle in a transport direction and drive control of the roller unit in a fold line direction.

FIG. 16 is a flowchart showing an example of the process of the drive control of the sheet bundle in the transport direction and the drive control of the roller unit 60 in the fold line direction.

Figure 17:
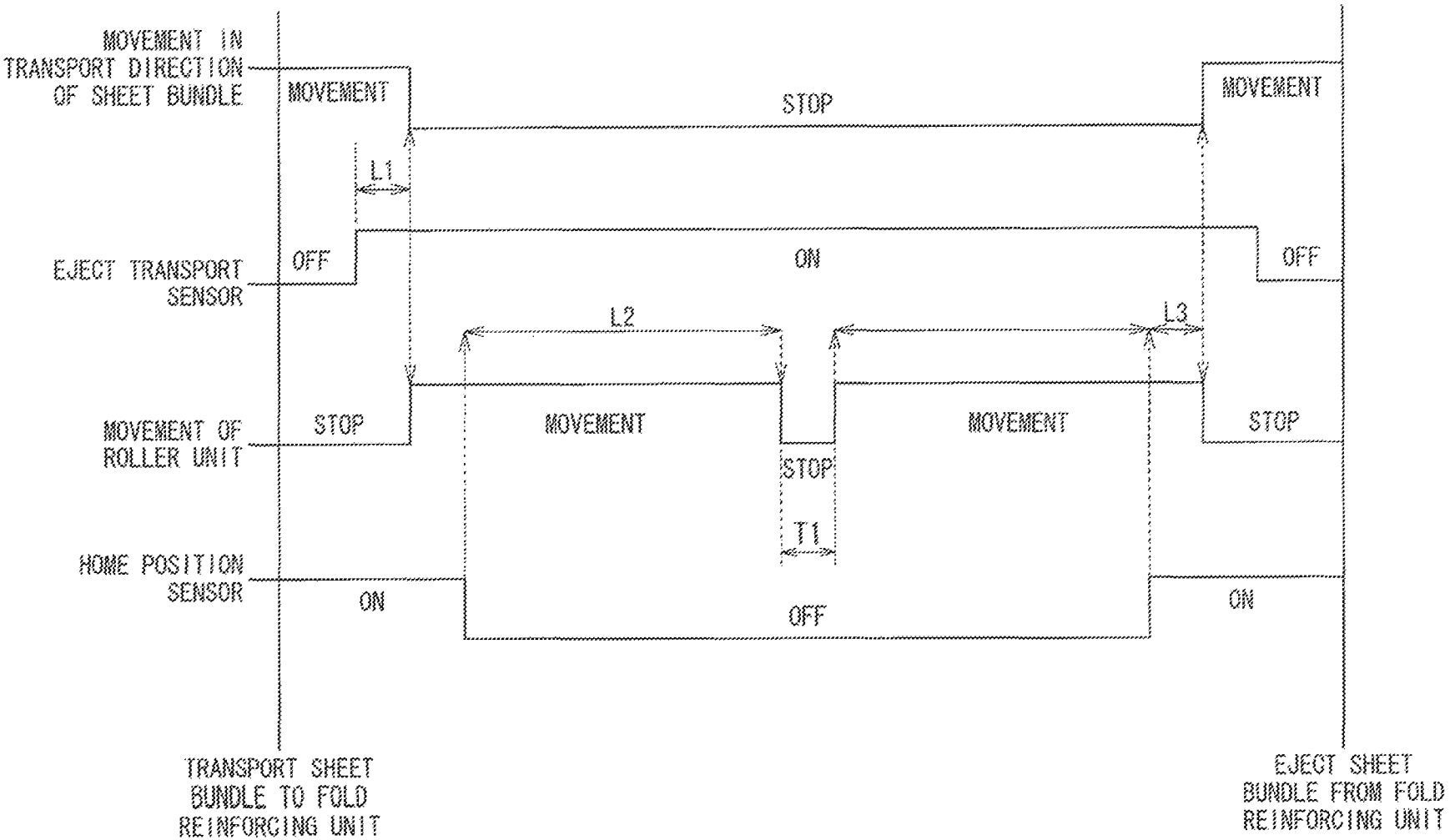
FIG. 17 is a timing chart showing a temporal relation among a movement and stop state of a sheet bundle in a transport direction, an on and off state of an eject transport sensor, a movement and stop state of the roller unit in the fold line direction, and an on and off state of a home position sensor.

Besides, FIG. 17 is a timing chart showing a temporal relation of the movement and stop state of the sheet bundle in the transport direction, the on and off state of the eject transport sensor S1, the movement and stop state of the roller unit 60 in the fold line direction, and the on and off state of the home position sensor S2.

First, at step ST1 of FIG. 16, the sheet bundle is moved in the transport direction and is transported to the fold reinforcing unit 50. Next, it is determined whether the leading edge of the sheet bundle reaches the position of the eject transport sensor S1 (step ST2). This determination is made based on the change of the eject transport sensor S1 from Off to On. Further, it is determined whether the leading edge of the sheet bundle is moved from the position of the eject transport sensor S1 by a specified amount L1 (step ST3). This determination is made based on the number of pulses of an encoder (not shown) of the fold roller motor.

When the leading edge of the sheet bundle, that is, the fold line is transported from the position of the eject transport sensor S1 by the specified amount L1, the movement of the sheet bundle in the transport direction is stopped (step ST4). At the same time, the movement (outgoing path) of the roller unit 60 from the home position is started (step ST5).

When the roller unit 60 is slightly moved from the home position, that is detected by the home position sensor S2, and the home position sensor S2 is changed from On to Off (step ST6).

The roller unit 60 further continues moving, and is stopped at a place (opposite side to the home position) which the roller unit reaches after movement of a specified amount L2 from the position where the home position sensor S2 is turned off (step ST7, step ST8). Incidentally, the movement amount L2 is obtained based on the number of pulses of the encoder of the drive motor 81.

When the roller unit 60 is stopped at the opposite side to the home position, the stop time is counted by an appropriate counter, and when the stop time reaches a specified time T1 (step ST9), the roller unit 60 starts the movement in the opposite direction (return path) (step ST10).

When the roller unit 60 approaches the home position, and passes through the position of the home position sensor S2, the home position sensor S2 is changed from Off to On (YES at step ST11). Thereafter, when movement of a specified amount L3 is performed (YES at step ST12), the movement of the roller unit 60 is stopped (step ST13). At this stage, the fold line reinforcing process is ended, and the sheet bundle is ejected from the fold reinforcing unit 50 (step ST14).

The above is the flow of the basic process of the drive control of the sheet bundle in the transport direction and the drive control of the roller unit 60 in the fold line direction. Next, modified examples of the above basic control will be described.

(5) First Modified Example of the Drive Control in the Transport Direction

Figures 18A, 18B:
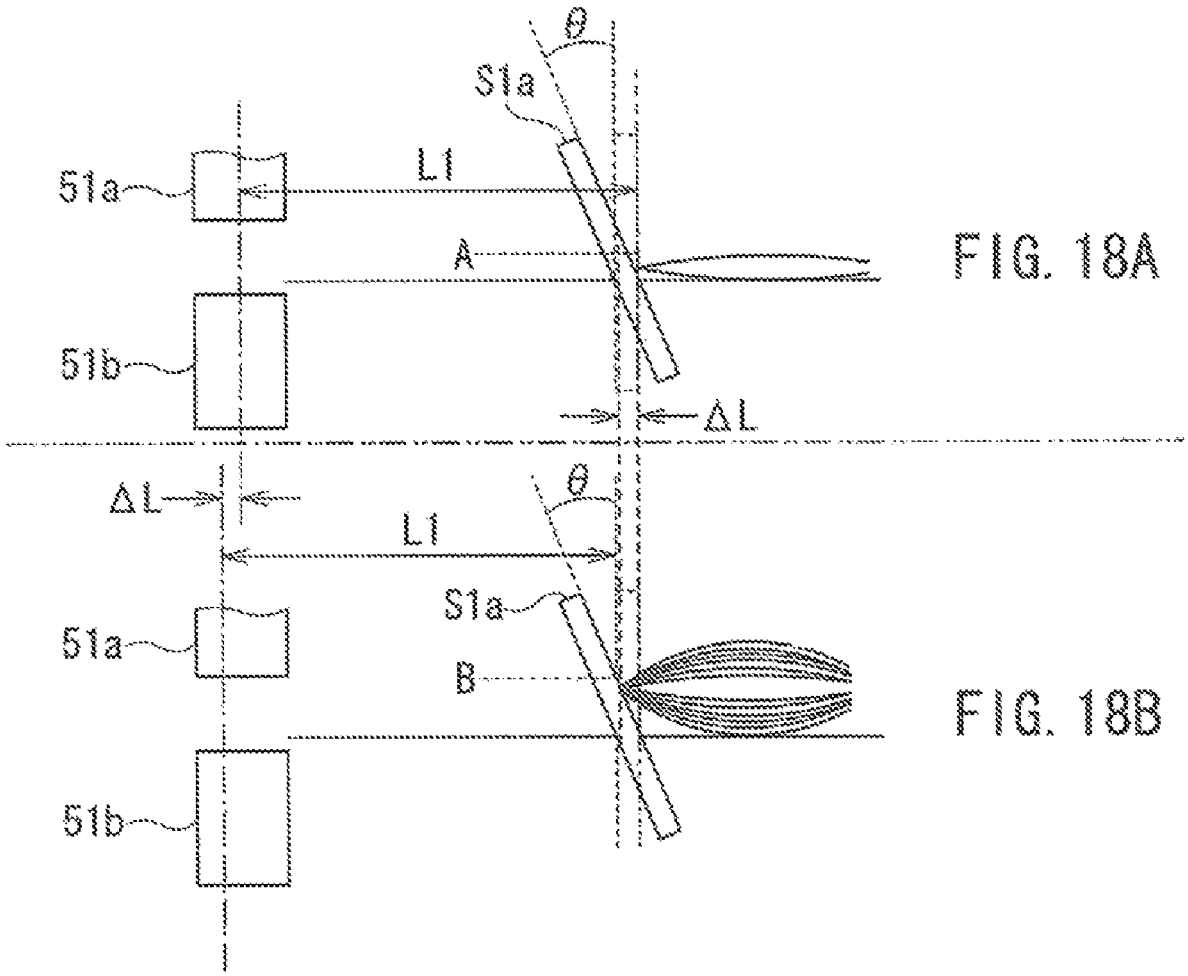
FIGS. 18A and 18B are views showing the operation concept of a first modified example of the drive control in the transport direction.

FIGS. 18A and 18B are views showing a concept of a first modified example. As described above, the position where the transport of the sheet bundle is stopped is made the position which the leading edge of the sheet bundle reaches after the movement of the specified distance L1 from the point where it passes through the eject transport sensor S1 (step ST2, ST3, ST4 of FIG. 16). The passing of the eject transport sensor S1 is detected based on whether the lever S1*a* is pushed down from the upright state. More specifically, when the lever S1*a* is rotated from the upright state by an inclination angle θ, it is detected that the eject transport sensor S1 is changed from Off to On.

However, when thicknesses A and B of sheet bundles are different from each other, as exemplified in FIGS. 18A and 18B, the positions of the leading edges of the sheet bundles where the same inclination angle θ is obtained are different from each other by ΔL. Thus, the stop position of the sheet bundle also varies by ΔL. The transport distance L1 is previously set so that the leading edge (that is, the fold line) of the sheet bundle is positioned at a desired position (for example, the center position in the roller width) in the width of the reinforce roller. However, according to the thickness of the sheet bundle, the fold line is not necessarily stopped at the desired position.

Then, in the first modified example, the transport distance L1 is made variable based on the information of the thickness of the sheet bundle, and the fold line is made to be always stopped at the desired position in the width of the reinforce roller.

Specifically, when the sheet bundle becomes thick, as compared with the case where the sheet bundle is thin, the passing of the leading edge is detected at a position where the leading edge is closer to the reinforce roller. Then, the transport distance at the time when the sheet bundle is thick is set to be shorter than that at the time when the sheet bundle is thin, so that the position of the stopped leading edge can be made constant.

The information of the thickness of the sheet bundle can be previously estimated from the number of sheets to be stitched. Besides, in the case where sheets different in thickness are contained, the thickness of the sheet bundle can be estimated from the kind information of the sheet and the number of sheets. The correspondence between the thickness information and the transport distance L1 is previously stored in an appropriate memory, and the optimum transport distance L1 has only to be selected according to the sheet number information and the sheet kind information inputted from the operation section 9 or the like.

According to the first modified example, even if the thickness of the sheet bundle varies, the fold line of the sheet bundle can always be stopped at the optimum position, and therefore, a more excellent fold line reinforcing operation can be realized.

(6) Second Modified Example of the Drive Control in the Transport Direction

A second modified example is a process effective especially in the case where the thickness of a sheet bundle is thin. In the case where a thin sheet bundle in which the number of sheets is two or three is stitched with staples, in a fold line portion, the thickness of the staple is larger than the thickness of the sheet bundle itself.

When the fold reinforcing process is performed on such a thin sheet bundle, the surface of the reinforce roller receives a load by the staple. When the fold reinforcing process is performed for a long time while the position of the staple (that is, the position of the fold line of the leading edge of the sheet bundle) and the position of the reinforce roller always keep the same positional relation, since the load is concentrated on one place of the reinforce roller, there is a case where the surface of the reinforce roller is damaged by the staple.

In order to deal with this problem, in the second modified example, a process is performed to intentionally distribute the stop position of the fold line within a specified range of the width of the reinforce roller.

Figure 19B:
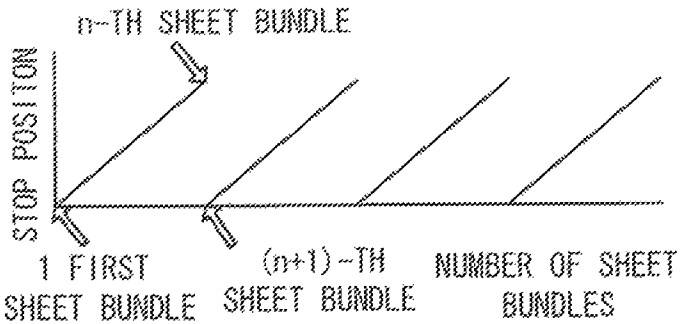
FIGS. 19A to 19D are views showing the operation concept of a second modified example of the drive control in the transport direction.
Figure 19C:
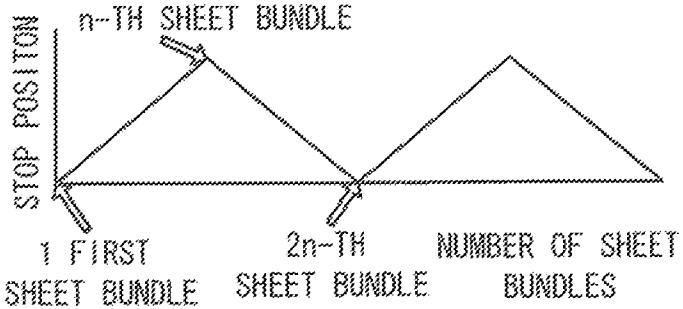
Figure 19D:
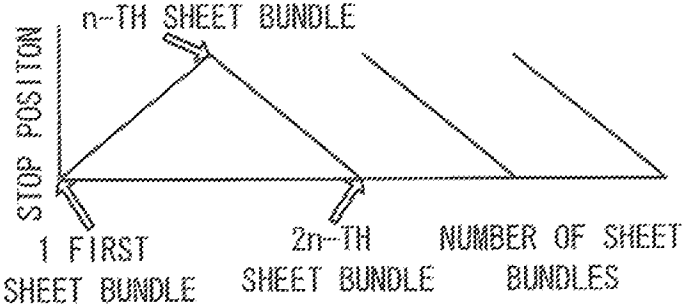
Figure 19A:
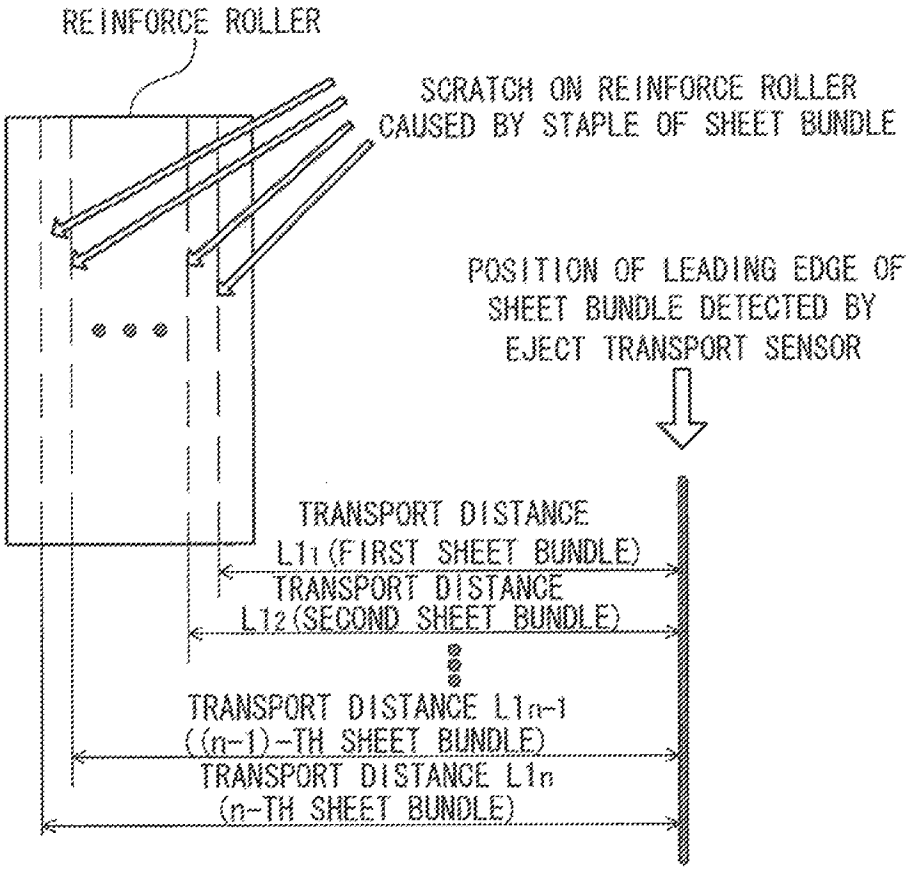

As shown in FIG. 19A, for example, a transport distance L1 is set ($L1_1$) so that, for the first sheet bundle, a fold line comes to the end side of the reinforce roller, and in the case where the fold reinforcing process is performed on the second sheet bundle, the transport distance L1 is set to be slightly longer ($L1_2$). In this way, the stop position of the fold line is successively changed within the specified width of the reinforce roller, so that the load by the staple is not concentrated on one place but is dispersed.

Although the method of dispersing the transport distance L1 is not particularly limited, for example, as shown in FIG. 19B, the transport distance L1 may be changed in a sawtooth form within the specified width of the reinforce roller, or may be changed in a triangular wave form as shown in FIG. 19C. Besides, as shown in FIG. 19D, the transport distance may be changed in a triangular wave form for the first to the 2n-th sheet bundle, and may be changed in a sawtooth form after that.

Besides, the latest value of the transport distance L1 at the time when the fold reinforcing process is performed is stored in a nonvolatile memory, and in the case where the fold reinforcing process is next performed, the stored transport distance L1 is used as an initial value, and the transport distance L1 may be increased or decreased from that. By doing so, irrespective of an interruption factor such as the turning-off of a power source, the stop position of the fold line can be uniformly dispersed within the specified width of the reinforce roller.

Incidentally, in the case where the sheet bundle is thick, it is not always necessary that the second modified example is performed, and it is determined according to the number of sheets to be stitched or the kind of sheet whether or not the second modified example is to be performed.

The drive control in the transport direction described above is performed in a control unit (not shown) of the sheet finisher 20.

(7) Modified Example of the Drive in the Fold Line Direction

This modified example is a modified example relating to the drive control of the roller unit 60 in the fold line direction. This modified example also intends to reduce the influence of a staple, and is a process effective in the case where a sheet bundle is thin.

As described above, in the sheet bundle in which the number of sheets is small, the thickness of a staple cannot be neglected relatively to the thickness of the sheet bundle itself, and also in the drive in the fold line direction, the influence of the staple is received. For example, when the reinforce roller pair 51 runs onto the staple, a shock is given to the sheet bundle, and a lateral shift occurs on the sheet bundle or a wrinkle occurs. Besides, the surface of the reinforce roller pair 51 itself is scratched by the staple.

Figure 20:
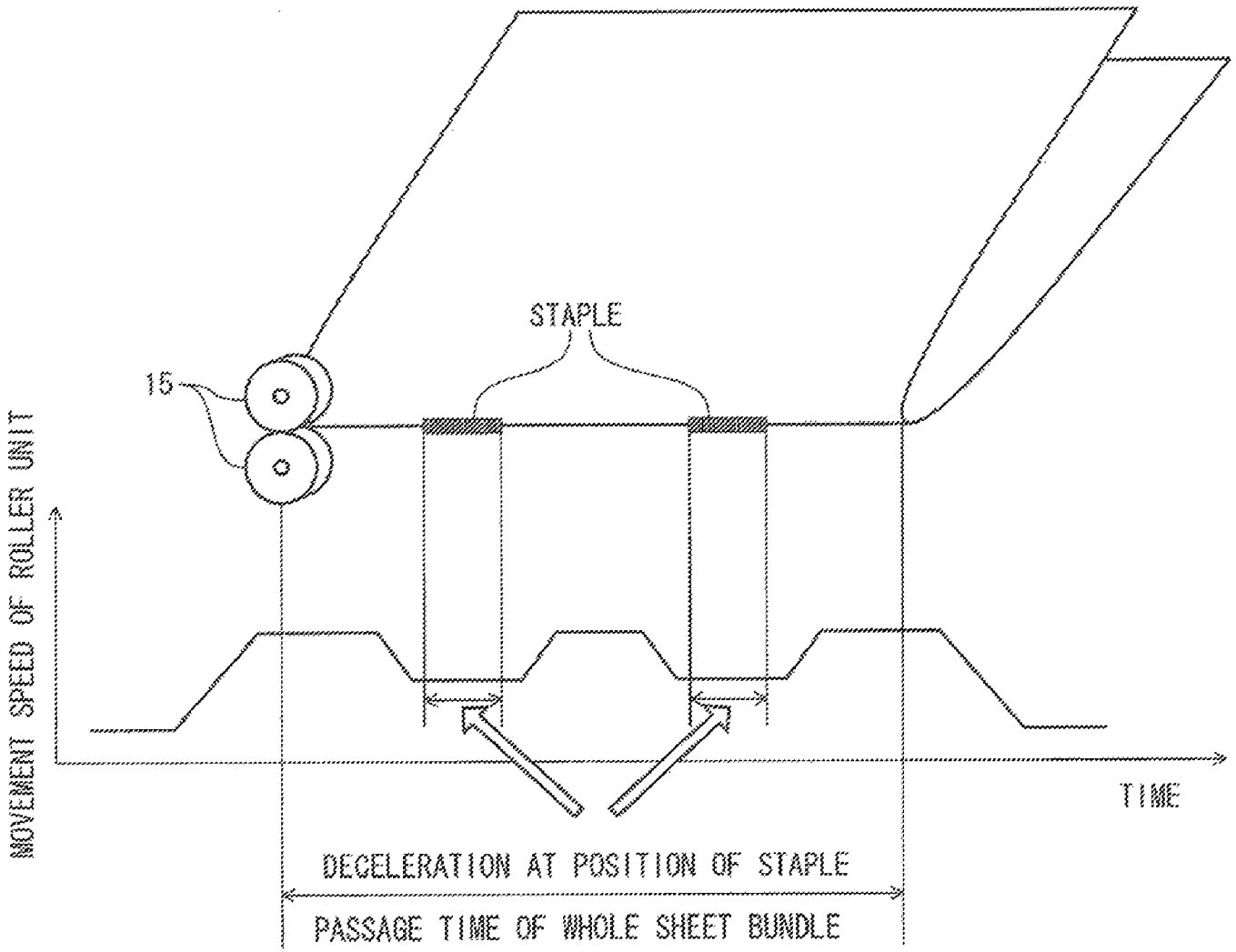
FIG. 20 is a view showing the operation concept of a modified example of the drive control of the roller unit in the fold line direction.

Then, in this modified example, as shown in FIG. 20, speed control is performed such that when the roller unit 60 approaches the vicinity of the staple (specified range including the edge of the staple), the movement speed is reduced from a standard speed (first speed), and the roller unit is moved on the staple at a speed (second speed) lower than the standard speed, and when it passes through the staple, acceleration is performed and the speed is returned to the standard speed. Since the reinforce roller pair 51 moves at the low speed from when it runs onto the staple to when it leaves the staple, the shock given to the sheet bundle is relaxed. Besides, as compared with the case where high speed movement is performed on the staple, the damage received by the reinforce roller pair 52 from the staple is reduced.

On the other hand, instead of moving at a slow speed on the whole of the staple, only when the roller unit 60 moves onto the edge of staple, the speed of the roller unit 60 may be reduced. When the roller unit 60 approaches the vicinity of the staple, the speed is reduced from the standard speed (first speed) to the second speed which is lower than the standard speed. Once the roller unit 60 has ridden onto the edge of the staple, the speed of the roller unit is returned to the standard speed even while running on the staple. This speed control can also relax the shock given to the sheet bundle and reduce the damage received by the reinforce roller pair 52 from the staple, because the influence of the staple is largest when the roller unit rides onto the edge of the staple. Further, this speed control can reduce total movement time as compared to the case where the roller unit 60 passes through the whole staple at the lower speed (i.e. the second speed).

In the image forming apparatus 10 of the embodiment, since the position of the staple is always constant irrespective of the sheet size, the timing of deceleration and acceleration can be determined based on the position information of the roller unit 60.

Incidentally, even in the case where the position of the staple varies according to the sheet size, since the position of the staple can be specified by capturing the information of the sheet size, the timing of deceleration and acceleration of the roller unit 60 can be similarly determined.

Besides, also in this modified example, in the case where the sheet bundle is thick, since the influence of the staple becomes low, it is not necessary to always perform the process, and it is determined according to the number of sheets to be stitched or the kind of the sheet whether or not the process of this modified example is performed.

Besides, the speed (second speed) at the passing over the staple may be set according to the thickness of the sheet bundle. For example, when the sheet bundle is thick, the speed at the passing over the staple is made to approach the standard speed, and when the sheet bundle is thin, a difference between the speed at the passing over the staple and the standard speed is set to be large.

When the sheet bundle is thick, since damage received from the staple is low, there is no trouble even if the movement on the staple is performed at the standard speed or a speed close to the standard speed, and the process time can be shortened.

In addition, the roller unit 60 is once stopped just before the staple, and then, it is accelerated and is returned to the standard speed.

The speed control in the fold line direction described above is performed in a control unit (not shown) of the sheet finisher 20.

(8) Fold Reinforcing Unit Relating to Other Embodiments

Figure 21A:
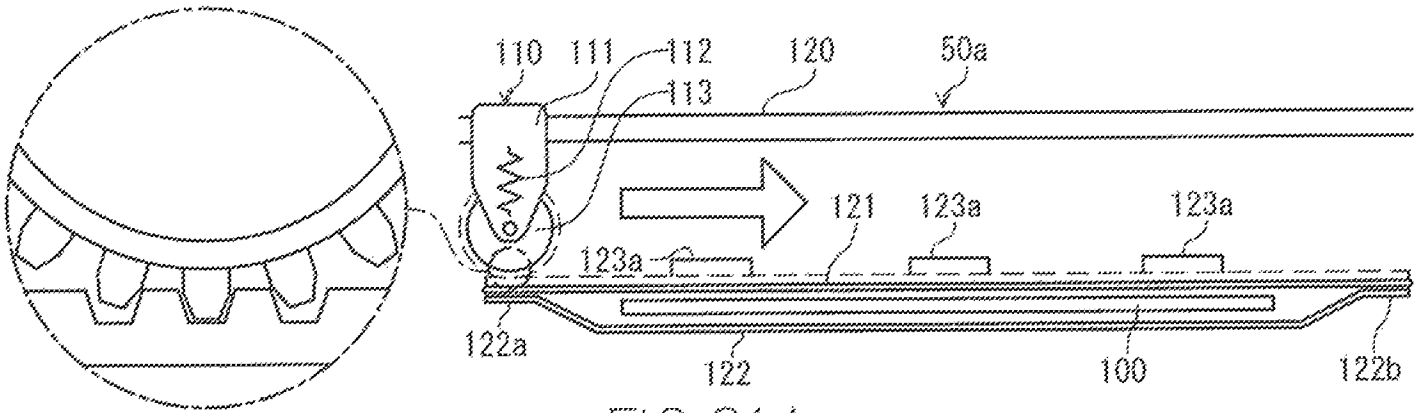
FIGS. 21A to 21C are views for schematically showing a structure of a fold reinforcing unit of a second embodiment and an operation concept.
Figure 21B:
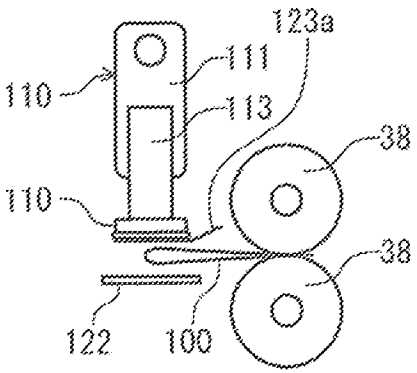
Figure 21C:
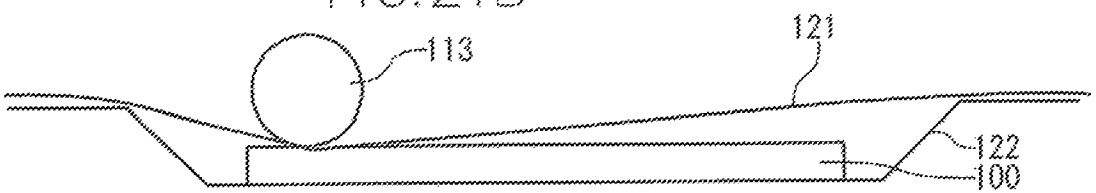

FIG. 21A to FIG. 21C are views schematically showing a structure of a fold reinforcing unit 50*a* of a second embodiment. The fold reinforcing unit 50 of the first embodiment has such structure that the reinforce roller pair 51 including the upper roller 51*a* and the lower roller 51*b* nip the sheet bundle from above and below and reinforce the fold line. On the other hand, the fold reinforcing unit 50*a* of the second embodiment has such structure that the fold line is reinforced by one reinforce roller 113.

The fold reinforcing unit 50*a* includes a roller unit 110, a support shaft 120 to support the roller unit 110 slidably in the fold line direction, a placement table 122 on which a sheet bundle 100 is placed, an upper guide 121 to press the sheet bundle 100 transported onto the placement table 122 from above, and a sheet guide 123 to guide the transport of the sheet bundle.

As shown in FIG. 21A, the placement table 122 is substantially trapezoidal when seen from the transport destination of the sheet bundle 100, and an area in which the sheet bundle 100 is carried has a recess shape and is slightly lower than placement table support sections 122*a* and 122*b* at both ends thereof. The placement table 122 is formed of a hard member of metal, hard resin or the like.

The upper guide 121 is a band-like elastic member formed of rubber or the like, both ends thereof are fixed to the placement table support sections (support plates) 122*a* and 122*b* by a specified tensile force, and keeps the horizontal state when the roller unit 110 is at the home position (left position in FIG. 21A, etc.).

The sheet guide 123 is a film-like member formed of a resin member of, for example, polyethylene terephthalate (PET). In order to smoothly perform the carrying-in of the sheet bundle 100, the sheet guide includes a guide valve 123*a* widened upward. The sheet guide 123 is attached to a plurality of places of the lower surface of the upper guide 121.

The roller unit 110 includes a frame 111, a compression spring 112, and a reinforce roller 113.

The upper part of the frame 111 is provided with a through hole through which the support shaft 120 passes, and can slide in the axial direction of the support shaft 120 by a not-shown drive mechanism.

The reinforce roller 113 can freely rotate around a roller shaft (not shown) which can fluctuate in the up-and-down direction with respect to the frame 111.

One end of the compression spring 112 is fixed to the upper part of the frame 111, and the other end is fixed to the roller shaft. A downward pressing force is exerted on the reinforce roller 113 by the elasticity of the compression spring 112.

Similarly to the first embodiment, the sheet bundle is pressed into the nip of a fold roller pair 38 by a fold blade 37, and a fold line is formed. Thereafter, the fold line of the sheet bundle is transported to substantially the center of the reinforce roller 113 by the rotation of the fold roller pair 38 and is stopped.

Thereafter, the roller unit 110 is moved in the fold line direction. Although the reinforce roller 113 starts to move while rotating on the upper guide 121, when passing through the placement table support section 122*a*, the fold roller descends by the elasticity of the compression spring 112, bends the upper guide 121 downward, and presses the sheet bundle by the elastic force of the compression spring 112 (see FIG. 21C). Although an upward elastic force to return to the horizontal position is generated from the upper guide 121, the compression spring 112 is selected to have such elastic force that the downward pressing can be performed with a sufficiently large force against the elastic force.

Since the upper guide 121 is formed of the elastic member such as rubber, the reinforce roller 113 can move on the upper surface of the upper guide 121 without sliding, and the stable fold line reinforcing process can be performed by the elastic force of the compression spring 112. Besides, the upper guide 121 intervenes between the reinforce roller 113 and the sheet bundle 100 in all the movement range of the reinforce roller 113. Thus, turning-up of the sheet does not occur at the end of the sheet bundle. Besides, since the reinforce roller 113 and the sheet bundle 100 do not come in direct contact with each other, a wrinkle or a scratch does not occur in the vicinity of the fold line.

Incidentally, as shown in the enlarged view of FIG. 21A, a rack may be formed on the upper surface of the upper guide 121, and a pinion may be formed on the outer periphery of the reinforce roller 113. By the rack and pinion structure, slide between the upper guide 121 and the reinforce roller 113 is reduced, and the reinforce roller 113 can be stably moved. Since the reinforce roller 113 presses the upper guide 121 at a pin point, the fold line can be reinforced by a higher pressure.

In the first embodiment, in order to ensure the passing path of the sheet bundle, it is necessary to provide the mechanism to raise or lower the transport guide 72 and the flexible member 73, and the mechanism to raise or lower the upper roller 51*a*. However, in the second embodiment, these drive mechanisms are not required, and the fold line process can be performed in the simple structure. Besides, there does not occur a noise due to the up-and-down movement of the transport guide 72 or the upper roller 51*a*.

FIG. 22A to FIG. 22F are views schematically showing a structure of a fold reinforcing unit 50*b* of a third embodiment, and particularly, the structure of a placement table 130 is mainly shown. The fold reinforcing unit 50*b* of the third embodiment reinforces the fold line by one reinforce roller 113 similarly to the second embodiment. Although the basic structure is almost equal to the second embodiment, a different point from the second embodiment is in the upper surface shape of the placement table 130. Then, hereinafter, the upper surface shape of the placement table 122A will be mainly described.

In the third embodiment, the upper guide 121 formed of the elastic member such as rubber is not used. Thus, when the reinforce roller 113 climbs over the end of a sheet bundle 100A or 100B, there is a fear that the sheet bundle is turned up and the sheet bundle is damaged.

Then, in the fold reinforcing unit 50*b* of the third embodiment, a groove-like edge clearance 130*a* or 130*b* is provided in the placement table 130 at a position corresponding to the end of the sheet bundle 100A or 100B.

Figure 22A:
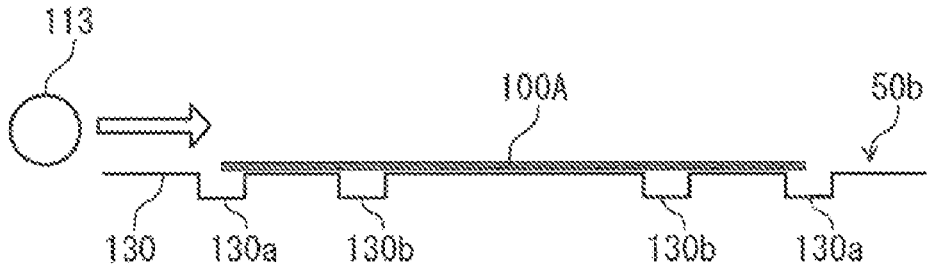
FIGS. 22A to 22F are views for schematically showing a structure of a fold reinforcing unit 50 of a third embodiment and an operation concept.
Figure 22B:
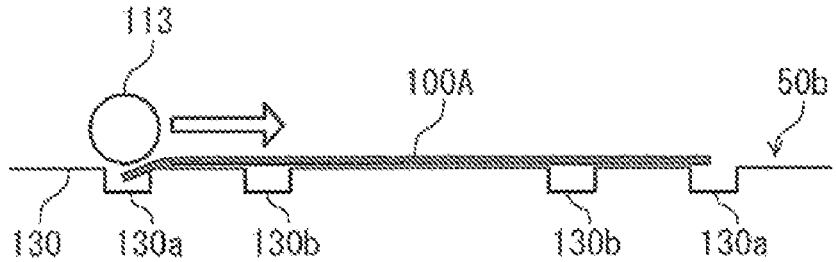
Figure 22C:
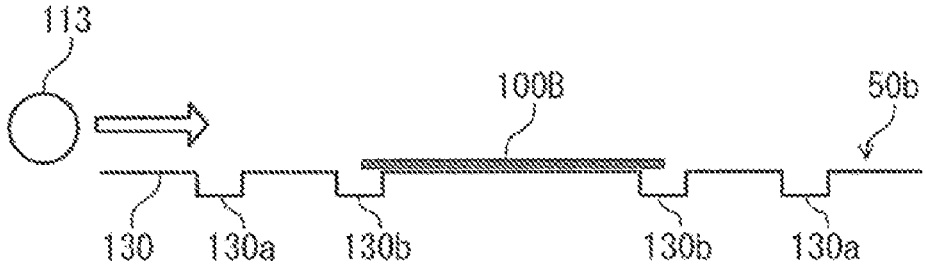
Figure 22D:
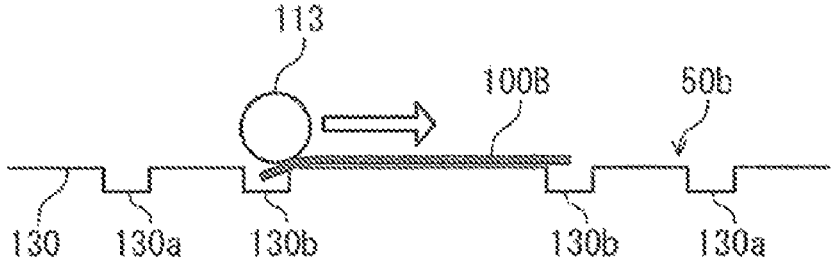

The edge clearance 130*a* is for the sheet bundle 100A of a large size (see FIGS. 22A and 22B), and the edge clearance 130*b* is for the sheet bundle 100B of a small size (see FIGS. 22C and 22D).

When the reinforce roller 113 starts to move from the home position, and reaches the end of the sheet bundle 100A or 1003, by the effect of the recess shape of the edge clearance 130*a* or 130*b*, the end of the sheet bundle 100A or 100B descends by the reinforce roller 113 (see FIG. 22B or FIG. 22D), and the end is not turned up.

Besides, since the edge clearance 130*a* or 130*b* is provided at the positions corresponding to both ends of the sheet bundle 100A or 100B, also when movement is made on the return path from the opposite side to the home position, the end is not turned up by the same effect.

Figure 22E:
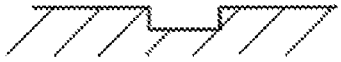
Figure 22F:
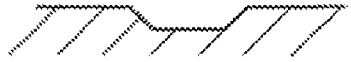

As exemplified in FIG. 22E, the groove shape of the edge clearance 130*a* or 130*b* may be the shape of the square section in which the side of the groove is vertical, or as exemplified in FIG. 22F, the shape may be the shape of the trapezoidal section in which the side of the groove is inclined.

Incidentally, when the fold line is once reinforced on the outgoing path, since the sheet bundle 100A or 100B is compressed to become considerably thin, the turning up phenomenon on the return path is hard to occur. Then, the structure may be made such that only the two edge clearances 130*a* and 130*b* (two left edge clearances 130*a* and 130*b* in FIG. 22A to FIG. 22D) corresponding to only the outgoing path are provided.

The present invention is not limited to the embodiments as described above, but can be embodied while modifying the components within the scope not departing from the gist at the practical stage. Besides, by a suitable combination of a plurality of components disclosed in the embodiments, the present invention of various embodiments can be formed. For example, some components may be deleted from all components disclosed in the embodiment. Further, components in different embodiments may be suitably combined.

What is claimed is:

1. A sheet finisher comprising:

a saddle stitch unit configured to stitch a center of a sheet bundle in which printed sheets are bundled;

a fold unit configured to fold the center stitched by the saddle stitch unit and to form a fold line;

a fold reinforcing unit that includes a reinforce roller, moves the reinforce roller along a direction of the fold line while applying pressure by the reinforce roller to the fold line of the sheet bundle transported from the fold unit, and reinforces the fold line; and a control unit configured to transport the sheet bundle from the fold unit to the fold reinforcing unit and control to stop the fold line of the sheet bundle at a position of the reinforce roller, the control unit changing successively a stop position of the fold line within a specified range of a width of the reinforce roller in accordance with increment of the number of the sheet bundles.

2. The sheet finisher according to claim 1, wherein the control unit successively changes the stop position of the fold line in accordance with the increment of the number of the sheet bundles in a job.

3. The sheet finisher according to claim 2, wherein the control unit determines thickness of the sheet bundle and successively changes the stop position in a case where the thickness of the sheet bundle is thinner than a specified value.

4. The sheet finisher according to claim 3, wherein the control unit determines the thickness of the sheet bundle based on the number of sheets stitched in the sheet bundle.

5. The sheet finisher according to claim 3, wherein the control unit determines the thickness of the sheet bundle based on the kind of sheets stitched in the sheet bundle.

6. The sheet finisher according to claim 1, further comprising a sensor that has a movable section and can detect a passing position of a leading edge of the sheet bundle by a variation of the movable section which is caused by passing of the leading edge of the sheet bundle, wherein, the control unit changes the transport distance from the passing position detected by the sensor to the position where the sheet bundle is stopped.

7. An image forming apparatus comprising:

a read unit configured to read an original document and to generate image data;

an image forming unit configured to print the image data to a sheet; and a sheet finisher to perform at least a stitching process and a folding process on the sheet printed by the image forming unit, wherein the sheet finisher comprises:

a saddle stitch unit configured to stitch a center of a sheet bundle in which printed sheets are bundled;

a fold unit configured to fold the center stitched by the saddle stitch unit and to form a fold line;

a fold reinforcing unit that includes a reinforce roller, moves the reinforce roller along a direction of the fold line while applying pressure by the reinforce roller to the fold line of the sheet bundle transported from the fold unit, and reinforces the fold line; and a control unit configured to transport the sheet bundle from the fold unit to the fold reinforcing unit and control to stop the fold line of the sheet bundle at a position of the reinforce roller, the control unit changing successively a stop position of the fold line within a specified range of a width of the reinforce roller in accordance with increment of the number of the sheet bundles.

8. The image forming apparatus according to claim 7, wherein the control unit successively changes the stop position of the fold line in accordance with the increment of the number of the sheet bundles in a job.

9. The image forming apparatus according to claim 8, wherein the control unit determines thickness of the sheet bundle and successively changes the stop position in a case where the thickness of the sheet bundle is thinner than a specified value.

10. The image forming apparatus according to claim 9, wherein the control unit determines the thickness of the sheet bundle based on the number of sheets stitched in the sheet bundle.

11. The image forming apparatus according to claim 9, wherein the control unit determines the thickness of the sheet bundle based on the kind of sheets stitched in the sheet bundle.

12. The image forming apparatus according to claim 7, further comprising a sensor that has a movable section and can detect a passing position of a leading edge of the sheet bundle by a variation of the movable section which is caused by passing of the leading edge of the sheet bundle, wherein, the control unit changes the transport distance from the passing position detected by the sensor to the position where the sheet bundle is stopped.

13. A sheet finishing method, comprising:

stitching a center of a sheet bundle in which printed sheets are bundled;

folding the sheet bundle at the stitched center to form a fold line;

transporting the sheet bundle of which the fold line is formed and controlling to stop the fold line of the sheet bundle at a position of the reinforce roller, and reinforcing the fold line by moving a reinforce roller along a direction of the fold line while pressing the reinforce roller to the fold line, a stop position of the fold line being successively changed within a specified range of a width of the reinforce roller in accordance with increment of the number of the sheet bundles.

14. The sheet finishing method according to claim 13, wherein the stop position of the fold line is successively changed in accordance with the increment of the number of the sheet bundles in a job.

15. The sheet finishing method according to claim 14, further comprising determining thickness of the sheet bundle, wherein the stop position of the fold line is successively changed in a case where the thickness of the sheet bundle is thinner than a specified value.

* * * * *